US006392624B1

(12) United States Patent
Yang et al.

(10) Patent No.: US 6,392,624 B1
(45) Date of Patent: May 21, 2002

(54) METHOD OF DRIVING LIQUID CRYSTAL DEVICE

(75) Inventors: Ying Bao Yang, Saitama; Keiichi Nito; Akio Yasuda, both of Tokyo, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 08/385,702

(22) Filed: Feb. 8, 1995

(30) Foreign Application Priority Data

Feb. 14, 1994 (JP) ..... 6-040422

(51) Int. Cl.[7] ..... G09G 3/36
(52) U.S. Cl. ..... 345/94
(58) Field of Search ..... 345/95–97, 92, 345/94; 349/172, 174, 85, 86

(56) References Cited

U.S. PATENT DOCUMENTS 4,712,877 A * 12/1987 Okada et al. ..... 345/97
5,047,758 A * 9/1991 Hartmann et al. ..... 345/97
5,061,044 A * 10/1991 Matsunaga ..... 345/97 X
5,128,663 A * 7/1992 Coulson ..... 345/94
5,200,846 A * 4/1993 Hiroki et al. ..... 349/174
5,343,217 A * 8/1994 Kim ..... 345/95
5,408,246 A * 4/1995 Inaba et al. ..... 345/97
5,508,711 A * 4/1996 Okada ..... 345/97

FOREIGN PATENT DOCUMENTS

EP 0453856 * 10/1991 ..... 345/97
GB 217335 A * 8/1986 ..... 345/94
GB 2218842 * 11/1989 ..... 345/97

* cited by examiner

*Primary Examiner*—Amare Mengistu
(74) *Attorney, Agent, or Firm*—Sonnenschein, Nath & Rosenthal

(57) ABSTRACT

Method of driving a liquid crystal display such as a ferroelectric liquid crystal display by multiplex addressing. The display has a pair of bases. A transparent electrode layer and an orientation film are formed in this order on each base. The two bases are placed opposite to each other with a certain gap between them. A ferroelectric liquid crystal material is inserted in the gap. Let $V_{thlow}$ be the voltage applied when the transmittivity of the liquid crystal material begins to change. Let $V_{thhigh}$ be the voltage applied when the transmittivity of the liquid crystal material substantially assumes its maximum value. First and second select pulses of opposite polarities are applied to the liquid crystal material. Let $V_{s1}$ be the voltage of the first select pulse. Let $V_{s2}$ be the voltage of the second select voltage. This method is characterized in that $V_{s1}=\pm(V_{thlow}-\Delta V)$, where $\Delta V>0$, and that $V_{s2}=\mp(V_{thhigh}+\Delta V)$, where $\Delta V>0$.

13 Claims, 18 Drawing Sheets

WAVEFORM DRIVING CELLS

STRUCTURE OF SIMPLE XY MATRIX PANNEL

THRESHOLD VALUE CHARACTERISTIC
OF FERROELECTRIC LIQUID CRYSTAL $$d1 + d2 = d_{gap}$$

$$Eeff = \frac{\varepsilon_2}{\varepsilon_1 d_2 + \varepsilon_2 d_1} \times V_{gap} \quad ---- \quad (1)$$

ε1 : DIELECTRIC CONSTANT OF LIQUID CRYSTAL

ε2 : DIELECTRIC CONSTANT OF ADDED FINE PARTICLES

SCANNING WAVEFORMS

DATA WAVEFORMS
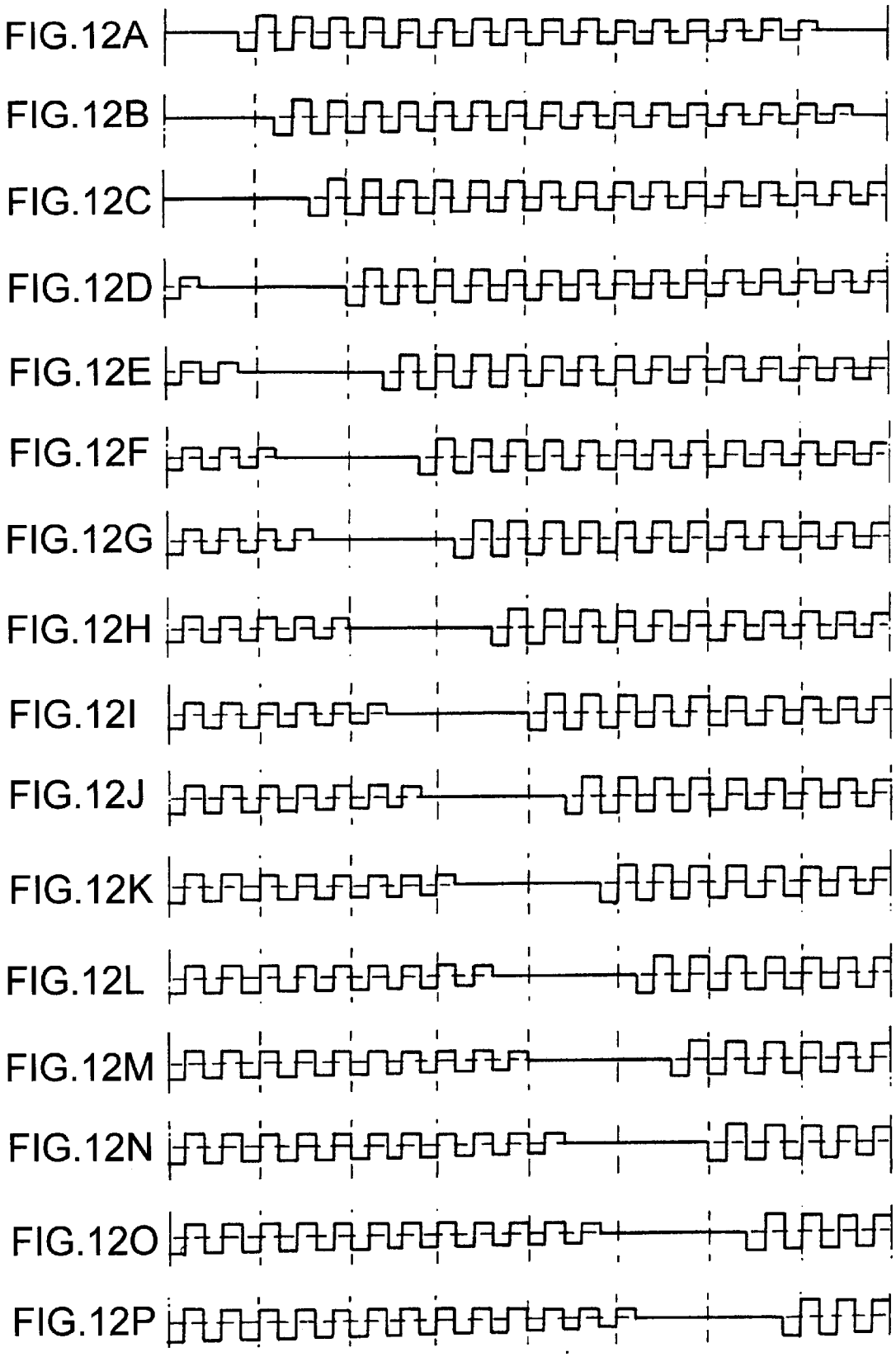

MODEL OF FERROELECTRIC LIQUID CRYSTAL

THRESHOLD VALUE CHARACTERISTIC OF FERROELECTRIC LIQUID CRYSTAL

TWISTED ORIENTATION OF LIQUID CRYSTAL MOLECULES

UNIFORM ORIENTATION OF LIQUID CRYSTAL MOLECULES

METHOD OF DRIVING LIQUID CRYSTAL DEVICE

BACKGROUND OF THE INVENTION

The present invention relates to a method of driving a liquid crystal device comprising a liquid crystal material sandwiched between a pair of bases and, more particularly, to a method of driving a liquid crystal device comprising a pair of substrates on each of which a transparent electrode layer and an orientation films are laminated in this order. The substrates are placed opposite to each other with a given spacing between them. A ferroelectric liquid crystal material is injected into the gap.

Twisted-nematic liquid crystal devices presently available as commercial products use TFTs (thin-film transistors) forming an active matrix construction to produce a given gray scale. However, the production yield of the prior art process for fabricating these TFTs is not sufficiently high. Also, the cost is still high. For these reasons, there is a demand for a display device of larger area.

On the other hand, a display device utilizing a ferroelectric liquid crystal of surface stabilized bistable type does not need an active matrix construction consisting of TFTs or the like. Therefore, there is the possibility that an inexpensive, large-area display device is fabricated from this ferroelectric liquid crystal.

In an attempt to use ferroelectric liquid crystals as display devices, researches and developments have been vigorously made in these ten years. Generally, ferroelectric liquid crystals have the following excellent features:

(1) High-speed response. The response is 1000 times as high as the response of the prior art nematic liquid crystal display.

(2) They depend less to the viewing angle.

(3) They exhibit a memory effect.

A known technique for displaying an image on such a ferroelectric liquid crystal display is described by Clark et al. in U.S. Pat. No. 4,367,924. Specifically, the cell gap of the display panels is controlled within 2 $\mu$m. The liquid crystal molecules are oriented by a restricting force which orients the molecules at the interface of the panels. The surface of this ferroelectric liquid crystal assumes only two stable energy states. Because of the response is on the order of microseconds and because of the image memory effect, researches and developments have been earnestly conducted.

In this kind of bistable mode-ferroelectric liquid crystal display, the memory effect is produced and, therefore, flicker which is a problem with a CRT can be prevented. Even in a simple XY matrix construction, the display can be driven with more than 1000 scanning lines. That is, it is not necessary to drive TFTs. Nematic liquid crystals which dominate presently have the disadvantage that the viewing angle is narrow. In contrast with this, the ferroelectric liquid crystal has a wide viewing angle because the molecular orientation is uniform and because the gap between the panels is less than half of the nematic liquid crystal panel.

Such a ferroelectric liquid crystal is constructed as schematically shown in FIG. 16. In particular, a transparent substrate 1*a* is made of glass. A transparent electrode layer 2*a* and a $SiO_2$ oblique deposition layer 3*a* are successively deposited on the substrate 1*a*, thus forming a laminate A. The electrode layer 2*a* is made of ITO (indium tin oxide) that is a conductive oxide prepared by doping indium with zinc. The deposition layer 3*a* acts as a liquid crystal orientation film. Similarly, a transparent electrode layer 2*b* and a $SiO_2$ oblique deposition layer 3*b* are successively deposited on a substrate 1*b*, thus forming a laminate B. The $SiO_2$ oblique deposition layers 3*a* and 3*b* which are orientation films are placed in an opposite relation to each other. Spacers 4 are inserted to secure a given cell gap. In this way, a liquid crystal cell is fabricated. A ferroelectric liquid crystal material 5 is injected into the cell gap.

Although this ferroelectric liquid crystal has the excellent advantages as described above, it is difficult to realize a gray scale. In particular, the prior art ferroelectric liquid crystal utilizing bistable mode is stable only in two states and so this liquid crystal has been regarded as unsuited for creation of gray scale as required in a video tape recorder.

More specifically, when an external electric field E is applied to the prior art ferroelectric liquid crystal such as an interface stable type ferroelectric liquid crystal, the direction of orientation of molecules M is switched between state 1 and state 2, as shown in FIG. 17. The molecular orientation variations cause variations in the transmittivity if a liquid crystal display is installed between two mutually perpendicular polarizers. As a result, as shown in FIG. 18, the transmittance or transmittivity varies rapidly from 0% to 100% at a threshold voltage of $V_{th}$ in the presence of the applied electric field. Generally, this voltage range in which this transmittivity makes a transition as described above is less than 1 V. Furthermore, the threshold value $V_{th}$ is affected by minute variations in the cell gap. Therefore, in the prior art liquid crystal display, it is difficult to give a stable voltage range to the transmittivity-applied voltage characteristic curve. Hence, it is difficult or impossible to produce desired gray levels by controlling the voltage.

Accordingly, various methods for overcoming these difficulties have been proposed. In one method, subpixels are formed, and the pixel area is adjusted. Alternatively, pixel electrodes are divided to realize various gray levels (referred to as area gray scale method). Various gray levels are accomplished by repeating switching or line addressing in one field, by making use of high-speed switching of a ferroelectric liquid crystal (referred to as time integration gray scale method). However, these methods do not yet provide satisfactory gray scale.

In particular, in the area gray scale method, as the number of gray levels is increased, the required subpixels are increased. It is obvious that the cost performance is poor in terms of fabrication of devices and also in terms of method of driving the devices. Furthermore, where the time integration gray scale method is used alone, the practicability is low. Moreover, where the time integration gray scale method is employed in combination with the area gray scale method, the practicability is also low.

Accordingly, further methods for representing an analog gray scale in each pixel have been proposed. The distance between opposite electrodes is varied within one pixel, or the thickness of a dielectric layer formed between opposite electrodes is varied, so that a local electric field strength gradient is produced. Alternatively, the material of the opposite electrodes is varied to produce a voltage gradient.

However, complicated manufacturing steps are necessary to fabricate a liquid crystal display having analog gray level display characteristics which are at a practical level. In addition, it is very difficult to control the manufacturing conditions. Further, the manufacturing cost is high.

A still other ferroelectric liquid crystal is proposed in Japanese Patent Laid-Open No. 276126/1991. In particular, fine particles of alumina of 0.3 to 2 $\mu$m are sprayed on an orientation film. The ferroelectric liquid crystal is inverted between a portion in which the fine particles exist and a portion in which the fine particles do not exist. The inversion is controlled by application of a voltage. In this way, various gray levels are produced.

Where this known technique is utilized, it is quite difficult in practice to produce desired gray levels because the fine particles are too large and because the amount of the sprayed particles is not stipulated definitely.

For example, if fine particles having grain diameter of 0.3 to 2 $\mu$m is simply dispersed in a cell gap of 2 $\mu$m, then it is quite difficult in practice to subtly vary inversion of the liquid crystal within one pixel. Furthermore, the ferroelectric liquid crystal produces a visible image when the liquid crystal is in a birefringent mode. This makes more difficult to control the cell gap. As a result, color nonuniformities take place. We consider that this situation is similar to the present supertwisted-nematic display in which cell gap variations are required to be suppressed within 500 Å.

We have already discovered that addition of fine particles of carbon to a ferroelectric liquid crystal material can improve the electrooptical characteristics of the liquid crystal as described later. In an attempt to produce various gray levels on the ferroelectric liquid crystal having such electrooptical characteristics, a method using reset, select, and data signals to drive the liquid crystal, as illustrated in FIG. 19, has been proposed. It has been found, however, that when the liquid crystal is driven with these waveforms, the liquid crystal responds in the manner described now.

When data signal is 0, the liquid crystal molecules of the pixels to which the select signal is applied assume twisted orientation 1 for every pixel. That is, as shown in FIG. 20, the liquid crystal molecules located closest to the top substrate are oriented in a direction different to the direction of orientation of the liquid crystal molecules located closest to the bottom substrate. The direction of orientation of the molecules varies continuously in the direction of the cell. In this way, depending on the orientation, in whatever direction is the liquid crystal cell arranged between the two polarizers, it is impossible to reduce the transmittivity completely down to zero. If the data voltage increases, small domains of a second twisted orientation in which the top and bottom molecules are oriented in opposite directions are produced. As the data voltage is increased, the area of the molecules of the second twisted orientation increases. In this way, the molecules are switched to intermediate states between the two orientations, thus producing intermediate states between white and black. Hence, sufficiently high contrast cannot be accomplished.

SUMMARY OF THE INVENTION

It is an object of the present invention to provide a method adequate to drive a liquid crystal display, especially a ferroelectric liquid crystal, by a passive-matrix multiplexing drive method in such a way that an analog gray scale is realized easily and with certainty while maintaining high contrast.

The present invention resides in a method of driving a liquid crystal display comprising a pair of bases between which a liquid crystal material, especially a ferroelectric liquid crystal material is sandwiched. Let $V_{thlow}$ be the voltage applied when the transmittivity of the liquid crystal material begins to change. Let $V_{thhigh}$ be the voltage applied when the transmittivity of the liquid crystal material substantially assumes its maximum value. First and second select pulses of opposite polarities are applied to the liquid crystal material. Let $V_{s1}$ be the voltage of the first select pulse. Let $V_{s2}$ be the voltage of the second select voltage. This method of driving the liquid crystal display is characterized in that $V_{s1}=\pm(V_{thlow}-\Delta V)$, where $\Delta V>0$, and that $V_{s2}=\mp(V_{thhigh}+\Delta V)$, where $\Delta V>0$.

In this method, the voltage range in which the transmittivity of the liquid crystal material varies can be increased, depending on $\Delta V$, by setting the value of the voltage $V_{s1}$ of the first select pulse and the value of the voltage $V_{s2}$ of the second select voltage to $\pm(V_{thlow}-\Delta V)$ and $\pm(V_{thhigh}+\Delta V)$, respectively. This driving method is advantageous for representation of a gray scale. Since the voltage is varied within the above-described range, even if the data pulse, or data signal, is set high, transmittivity values producing a sufficient difference can be obtained. In consequence, high contrast can be obtained between two orientation states.

In the novel liquid crystal-driving method, in order to improve the analog gray scale representation, it is desired to matrix drive a liquid crystal display having regions for switching the contained liquid crystal material. These regions have subtly different threshold values which are distributed in a range.

In order to maintain electrical neutrality of the select pulse waveform and the reset pulse waveform, to assure switching, to prevent the liquid crystal material from deteriorating, and to assure resetting, first and second reset pulses having n times (n is a real number equal to or greater than 2) as long as the pulse widths of the first and second select pulses are applied prior to the first and second select pulses. The first and second reset pulses are of opposite polarities. The first reset pulse is of the same polarity as the second select pulse. The voltage of the first reset pulse is given by $V_{r1}=|(V_{thhigh}+\Delta V')|$, where $\Delta V'>0$. The second reset pulse is of the same polarity as the first select pulse. Preferably, the voltage $V_{r2}$ of the second reset pulse is given by $$n\,V_{r1}+V_{s2}=n\,V_{r2}+V_{s1} \tag{1}$$

For example, $2\,V_{r1}+V_{s2}=2\,V_{r2}+V_{s1}$.

Those voltages which are actually applied to the liquid crystal material to produce a gray scale are the first and second data pulses synchronized with the first and second select pulses. The first and second data pulses have the same pulse width as these select pulses and are of opposite polarities to these select pulses.

The novel method is adequate to drive a display device so as to produce various gray levels. This display device has glass substrates 1*a* and 1*b* having transparent electrodes 2*a* and 2*b*, respectively, as shown in FIG. 3. A material which shows optically bistable property such as a ferroelectric liquid crystal material 5 is sandwiched between the glass substrates 1*a* and 1*b*, thus forming a liquid crystal cell. In this case, in order to realize a gray scale, the use of a ferroelectric liquid crystal material containing fine particles of carbon is preferable.

The transparent electrodes include N scanning electrodes 2*b* extending in the X-direction on the substrate 1*b* and M scanning electrodes 2*a* extending in the Y-direction on the substrate 1*a*. An electrical signal for selecting and unselecting pixels is applied to the transparent electrodes 2*b* extending in the Y-direction. An electrical signal for displaying the contents of information, (i.e., producing black, white, and intermediate tones) is applied to the transparent electrodes 2*a* running in the X-direction. The device is driven by matrix multiplexing.

The liquid crystal material driven by the novel method has preferably regions having subtly different threshold values for switching the liquid crystal material. Where a black domain exists among white domains (or vice versa), the black domain is referred to as the reversed domain herein. If the transmittivity of the reversed domain is 25%, more than 300, preferably more than 600, microdomains of more than 2 $\mu$m in diameter should exist in a field of view of 1 $mm^2$. Furthermore, the threshold values in these domains should vary in a range of more than 2 V at transmittivities of 10–90%.

The liquid crystal display driven by the novel method has preferably electrooptical characteristics as shown in FIG. 4. That is, in the prior art technique, the transmittivity varies steeply, depending on the applied voltage, as shown in FIG. 18. On the other hand, in FIG. 4, the transmittivity changes relatively mildly, for the following reason. Microdomains having subtly different threshold values $V_{th}$ appear in one pixel, and the transmittivity of the microdomain varies according to the magnitude of the applied voltage. In one domain, if the liquid crystal molecules show bistable property, a memory effect is produced. Still images free of flicker can be realized. Since one pixel is formed out of micrometer-order domains of different threshold values, continuously varying gray levels can be created.

The graph of FIG. 4 shows the relation of the transmittivity of a ferroelectric liquid crystal cell inserted between two mutually perpendicular polarizers to the voltage applied to the cell. The orientation of the cell is so determined that when a negative voltage exceeding the threshold value is applied to the liquid crystal cell between the polarizers, the transmittivity of the cell assumes its minimum value. The transmittivity of the liquid crystal varies continuously over a range in response to the applied voltage. Let $V_{thlow}$ be the voltage at which the transmittivity of the liquid crystal material begins to vary. Let $V_{thhigh}$ be the voltage at which the transmittivity of the liquid crystal material assumes its maximum value. The following relation is obtained:

$$V_{thhigh}-V_{thlow}>0$$

In FIG. 4, different threshold values result in different transmittivities. Of these different threshold values, let $V_{th1}$ be the threshold value obtained when the transmittivity is 10%. Let $V_{th2}$ be the threshold value obtained when the transmittivity is 90%. In this case, the range in which the threshold voltage varies ($\Delta V_{th}=V_{th2}-V_{th1}$) is preferably in excess of 2 V.

With respect to microdomains, as shown in FIG. 5(A), microdomains MD having diameters exceeding 2 $\mu$m exist preferably at a density of more than 300/$mm^2$ when the transmittivity is 25%. These microdomains transmit light at subtly varying transmittivities. As a whole, intermediate tones can be accomplished. Since this microdomain structure assumes an aspect resembling starlight, this structure is hereinafter referred to as the "starlight texture".

Because of this starlight texture the microdomains MD can be enlarged (i.e., the transmittivity is increased) as indicated by the dot-and-dash lines in FIG. 5(A) or diminished (i.e., the transmittivity is reduced), according to the amplitude of the applied voltage. Hence, the transmittivity can be varied arbitrarily, depending on the applied voltage. On the other hand, in the prior art structure, the threshold values are distributed in a quite narrow range as shown in FIG. 5(B). Therefore, in response to the applied voltage, those portions D which transmit light enlarge suddenly or disappear. Consequently, it is quite difficult to create various gray levels.

In the present invention, as a means for forming the microdomains, ultrafine particles such as fine particles of carbon can be dispersed in a liquid crystal material. FIG. 6 shows a ferroelectric liquid crystal display in which such ultrafine particles 10 are dispersed. This structure is essentially the same as the structure shown in FIG. 15.

The principle on which the threshold value is varied by the ultrafine particles 10 is now described by referring to FIG. 7. Let $d_2$ be the diameter of the ultrafine particles 10. Let $\epsilon_2$ be the dielectric constant of these particles. Let $d_1$ be the thickness of the liquid crystal material 5 excluding the ultrafine particles. Let $\epsilon_1$ be the dielectric constant of the liquid crystal material. The electric field Eeff acting on the ultrafine particles is given by $$Eeff=(\epsilon_2/(\epsilon_1 d_2+\epsilon_2 d_1))\times Vgap \quad (2)$$

Therefore, if the ultrafine particles having a dielectric constant smaller than that of the liquid crystal material are added ($\epsilon_2<\epsilon_1$), it follows that the fine particles ($d_2$) smaller than the total thickness $d_{gap}$ ($=d_1+d_2$) of the liquid crystal material layer are entered. Thus, $$Eeff<Egap$$

As a result, a weaker electric field Eeff acts on the liquid crystal material than the field (Egap) acting when no ultrafine particles are entered. Conversely, if fine particles having a dielectric constant larger than that of the liquid crystal material is added ($\epsilon_2>\epsilon_1$), the relation given by $$Eeff>Egap$$

is obtained. In consequence, a stronger electric field Eeff acts on the liquid crystal material than the field Egap acting when no fine particles are entered.

In summary, the following relations hold:

$$\text{When } \epsilon_1>\epsilon_2,\ Eeff<Vgap/(d_1+d_2)=Vgap/d_{gap}=Egap \quad (1)$$

$$\text{When } \epsilon_1=\epsilon_2,\ Eeff=Egap \quad (2)$$

$$\text{When } \epsilon_1<\epsilon_2,\ Eeff>Egap \quad (3)$$

In any case, the effective electric field Eeff applied to the liquid crystal material itself is varied by the addition of the ultrafine particles. It follows that the effective electric field applied to those regions of the liquid crystal material in which the ultrafine particles exist is different from the effective field applied to those portions of the liquid crystal material in which the ultrafine particles do not exist. As a result, even if the same electric field Egap is made to act on the liquid crystal material, reversed domains appear in some regions but do not in the other regions. In this way, the starlight texture structure as shown in FIG. 5(A) can be developed.

The above-described starlight texture structure is adapted for creation of continuously varying gray levels. Various transmittivities (i.e., two or more gray levels) can be obtained by controlling the applied voltage (i.e., its amplitude, pulse width, or the like) under the presence of ultrafine particles. On the other hand, where fine particles are simply added as in the prior art techniques, only the structure shown in FIG. 5(B) is derived. Obviously, even if fine particles of 0.3 to 2 $\mu$m are dispersed in a minute gap (on the order of 2 $\mu$m), the desired display characteristics are not obtained. Apart from the minute gap, fine particles cause unwanted color nonuniformities, which will be described in detail in Comparative Example. In the present invention, such an undesirable phenomenon does not take place. Rather, the desired performance can be obtained.

In the novel liquid crystal display, the fine particles added to the liquid crystal material should cause the effective electric field strength applied to the liquid crystal material 5 to be distributed over a range, the liquid crystal material 5 existing between opposite transparent electrode layers 2*a* and 2*b* shown in FIG. 6. For example, fine particles of plural kinds having different dielectric constants may be mixed and used. The presence of fine particles having the different dielectric constants produces a distribution of dielectric constant within each pixel. As a result, if a uniform external electric field is applied between the transparent electrode layers 2*a* and 2*b* of the pixels, the effective electric field intensity applied to the liquid crystal material in the pixel has a distribution. This increases the range of the threshold voltage for switching the liquid crystal material, especially the ferroelectric liquid crystal material. Hence, an analog gray scale can be accomplished within one pixel.

Where fine particles of the same dielectric constant are used, the sizes of the particles should have a distribution. In this way, the thickness of the liquid crystal material layer is made to have a distribution by the presence of the fine particles which are not different in dielectric constant but differ in size. As a result, even if a uniform external electric field is applied between the transparent electrode layers 2*a* and 2*b* within one pixel, the effective electric field strength applied to the liquid crystal material within the pixel exhibits a distribution. This permits creation of an analog gray scale. If the sizes of the fine particles are distributed over a considerably wide range, an excellent analog gray scale can be accomplished.

In a liquid crystal display for use in the present invention, fine particles added to the liquid crystal material have surfaces preferably having pH of more than 2.0 because if the pH is less than 2.0, the acidity is too strong. In this case, the liquid crystal material is readily deteriorated by protons.

Preferably, the fine particles added to the liquid crystal material is less than 50% by weight and higher than 0.1% by weight. If the amount of addition is too large, the particles coagulate, thus making it difficult to develop the starlight texture structure. Also, it is often difficult to inject the liquid crystal material.

The usable fine particles can be carbon black and/or titanium oxide. In one example, the carbon black is carbon black fabricated by the Farness' process, and the titanium oxide is amorphous titanium oxide. The grain sizes of the fine particles of carbon black produced by the Farness' process have a relatively wide distribution. The amorphous titanium oxide has good surface properties and excellent durability.

Used fine particles preferably have sizes which are half (less than 0.4 $\mu$m, more preferably, less than 0.1 $\mu$m) of the liquid crystal cell gap when they are not coagulated, i.e., in a primary fine particle state. The gray level display characteristics can be controlled by the grain size distribution. Where the standard deviation of the grain size distribution is more than 9.0 nm, the variations in the transmittivity or transmittance can be made milder with desirable results. If the specific gravity of the fine particles is 0.1 to 10 times the specific gravity of the liquid crystal material, the fine particles are prevented from settling when they are dispersed in the liquid crystal material. If the surfaces of the fine particles are processed with silane coupling agent or the like, good dispersion is obtained.

In the present example, it is necessary that the fine particles exist between the electrodes 2*a* and 2*b* opposite to each other. No restrictions are imposed on the locations in which the fine particles are placed. The particles may be positioned within the liquid crystal material 5, within the orientation films 3*a* and 3*b*, or on these films 3*a* and 3*b*.

A liquid crystal display used in the present invention can be fabricated by an ordinary method. For example, a transparent ITO film is formed on a glass substrate by sputtering technique. The film is patterned photolithographically. Then, SiO is obliquely deposited on the substrate by vacuum evaporation. After a liquid crystal cell is assembled, a liquid crystal material in which fine particles are uniformly dispersed is injected into the cell gap. In this manner, the liquid crystal display is fabricated. A rubbed film of polyimide or a film on which SiO is deposited obliquely can be used as a liquid orientation film.

Where the orientation film is a film formed by depositing silicon oxide, the layer is annealed after the deposition. The surface property is varied, so that a starlight texture structure is developed.

The present invention is well suited for the above-described starlight texture structure to which fine particles are added. The invention can also be applied to an ordinary liquid crystal structure not having the starlight texture structure.

That is, the invention improves the driving waveforms used in a liquid crystal display (especially, an inexpensive, large area liquid crystal display driven by passive matrix addressing without needing TFTs or the like) capable of developing the above-described starlight texture structure. The driving waveforms are used to cause the liquid crystal material to produce intermediate tones. The transmittivity of the liquid crystal material varies continuously over a certain range in response to an applied voltage.

One driving waveform used in the novel method are an electrical select signal (scanning waveform) applied to the scanning electrodes 2*b* formed on the substrate 1*b*, as shown in FIG. 1(*a*). The scanning electrodes 2*b* extend along the Y-direction. This waveform has the following features.

(1) The select signal is composed of two kinds of pulses, or positive pulses $V_{s1}$ and negative pulses $V_{s2}$. As shown in FIG. 4, the threshold voltage of the transmittivity variation ($T_r$)-applied voltage (V) curve of the liquid crystal cell between the two mutually crossing polarizers is $V_{thlow}$. The select pulse voltage is determined by the threshold value of the liquid crystal display. The pulse width is determined by the response speed of the liquid crystal material.

The height of the positive select pulses $V_{s1}$ is the difference between the voltage $V_{thlow}$ at which starlight texture appear on the monodomain structure of the liquid crystal material displaying black and $\Delta V$, i.e., $V_{thlow}-\Delta V$. The height of the negative select pulses $V_{s2}$ is the sum of the voltage $V_{thhigh}$ at which the liquid crystal state is completely switched to a state in which white is displayed and $\Delta V$, i.e., $-(V_{thhigh}+\Delta V)$. $\Delta V$ is a positive voltage. To produce various gray levels, the voltage $\Delta V$ is required to have a larger value but it is restricted by the voltage of the driver circuit. This voltage $\Delta V$ increases the range of the threshold value. This is quite advantageous to obtain a gray scale.

(2) Two reset pulses $V_{r1}$ and $Vr_2$ are applied before the select pulses $V_{s1}$ and $V_{s2}$. These reset pulses are n times as wide as the select pulses. For instance, the width of the reset pulses is two times the width of the select pulses. The voltage of the reset pulses is determined according to the following relations. The first reset pulses $V_{r1}$ are of the same polarity as the second reset pulses $V_{s2}$. The second reset pulses $V_{r2}$ are of the same polarity as the first select pulses $V_{s1}$. The first reset pulses $V_{r1}$ act to completely switch the present display state of the liquid crystal material to another state. The voltage of the first reset pulses $V_{r1}$ is the sum of the $V_{thhigh}$ and a low voltage $\Delta V'$. This low voltage $\Delta V'$ assures resetting of the liquid crystal material. The voltage $V_{r2}$ of the second reset pulses is determined according to the following equation.

$$n\ V_{r1}+V_{s2}=n\ V_{r2}+V_{s1} \quad (1)$$

where n is a real number equal to or greater 2. Normally, n is 2 to 4, preferably about 2. For example, $2\ V_{r1}+V_{s2}=2\ V_{r2}+V_{s1}$; $V_{r2}>V_{thhigh}$. In the Eq. (1) above, $V_{r1}$, $V_{r2}$, $V_{s1}$, and $V_{s2}$ are the voltages of the first reset pulses, the second reset pulses, the first select pulses, and the second select pulses, respectively.

The condition given by the Eq. (1) above is used to maintain electrical neutrality of the select waveforms and of the reset waveforms. When a dc electric field is applied to a liquid crystal material, it induces an electrode reaction or electrode process on the surface of the orientation film. As a result, electric charges tend to be accumulated on one electrode. This degrades the liquid crystal material. The electric charges are neutralized by setting the pulse voltages under the condition of Eq. (1) above. Hence, the liquid crystal material is prevented from deteriorating.

An electrical data signal applied to the data electrodes 2*a* which are formed on the substrate 1*a* in the X-direction is shown in FIG. 1(*b*). This waveform has the following features:

(1) The electrical data signal is composed of a negative pulse $V_{D1}$ and a positive pulse $VD_2$ whose waveforms are symmetrical. These pulses have the same width as the select pulses $V_{s1}$ and $V_{s2}$. The height $V_D$ of the data voltage varies from 0 to $V_{thhigh}-V_{thlow}$ according to the gray level to be displayed on the liquid crystal display.

(2) The voltage pulses $V_{D1}$ and $V_{D2}$ are of opposite polarity to the select pulses $V_{s1}$ and $V_{s2}$. In this way, the voltage applied to the pixel at the address (n, m) on the display is the sum $V_s+V_D$, which is shown in FIG. 1(*c*).

With respect to pulse widths, it is assumed that the reset pulse width is equal to the select pulse width, or the data pulse width, as shown in FIG. 2. When the phase of one data pulse is reversed and applied as indicated by the broken lines, the reset pulses $V_{r1}$ and $V_{r2}$ are reduced to levels $V_{r1}'$ and $V_{r2}'$, respectively, by an amount corresponding to the data pulse. As a result, resetting cannot be effected. However, the reset pulse width is set to a value that is n times the select pulse width, or the data pulse width. Therefore, even if the phase of the data pulse is reversed, it is assured that sufficient reset pulse voltage ($\geqq V_{r1}$, $V_{r2}$) is obtained. Hence, resetting can be carried out with certainty at all times.

The driving method using the above-described driving waveforms is summarized as follows (see FIG. 1(*c*)).

(1) At voltage $V_1$, the presently displayed gray level is once reset completely to white state. Since the voltages $V_1$ and $V_4$ are of the same polarity, the currently displayed level is momentarily brought to white level.

(2) At voltage $V_2$, the liquid crystal material reset to white level is reset completely back to black level, thus making preparations for the next writing.

(3) Whatever data voltage is applied, voltage $V_3$ is lower than the voltage $V_{thlow}$. Therefore, the ferroelectric liquid crystal material does not respond at this time. However, since the voltages $V_3$ and $V_2$ are of the same polarity, the sum of these two voltages acts on the ferroelectric liquid crystal material. In any case, transmission is not affected, because black level is displayed.

(4) Voltage $V_4$ controls the gray level to be displayed next. The displayed gray level varies according to the area or amplitude of the voltage $V_4$.

Other objects and features of the invention will appear in the course of the description thereof, which follows.

BRIEF DESCRIPTION OF THE DRAWINGS

FIG. 12 is a diagram showing signal waveforms used in a method according to the invention;

DESCRIPTION OF THE PREFERRED EMBODIMENTS

EXAMPLE 1

To confirm the validity of driving waveforms according to the present invention, driving voltages were applied to a liquid crystal cell having a single pixel. We have confirmed that the transmittivity of the cell sandwiched between two mutually crossing polarizers can be controlled.

The cell was fabricated in the manner described now. Two ITO glass substrates were prepared. Each glass substrate measured 40×20×3 $mm^3$ and had transparent electrodes. The liquid crystal cell was fabricated from these substrates. Each glass substrate was made from ordinary soda lime glass. The transparent electrodes were formed by sputtering to a thickness of 500 Å. The resistance of the ITO was 100 $\Omega/cm^2$.

An orientation film for orienting the liquid crystal molecules was formed on each substrate by depositing SiO obliquely as a film. The deposition angle was 80 degrees. The thickness of the orientation film was 500 Å. Two kinds of liquid crystal cell were created. In these two liquid crystal cells, the deposition directions were parallel and antiparallel, respectively. The gap of each liquid crystal cell was controlled by adding fine particles of silica to a sealant for bonding together two glass substrates. The silica particles had sizes of 1.4 to 2.0 $\mu$m.

CS-1014 produced by Chisso Petrochemical Corporation, Japan, was used as a ferroelectric liquid crystal material. When the liquid crystal material was injected, it was deaerated in isotropic phase at 110° C. Similarly, in isotropic phase, the liquid crystal material was injected into the gap of 1.5 $\mu$m between the glass substrates by making use of capillary action. After the liquid crystal material was completely injected, the cell was gradually cooled down to room temperature in 2 to 3 hours.

At this time, fine particles of carbon were mixed as ultrafine particles into the ferroelectric liquid crystal material. In particular, the liquid crystal material was heated to isotropic phase, the fine particles of carbon were added, and the fine particles and the liquid crystal material were mixed up uniformly by an ultrasonic stirrer.

Figure 1A:
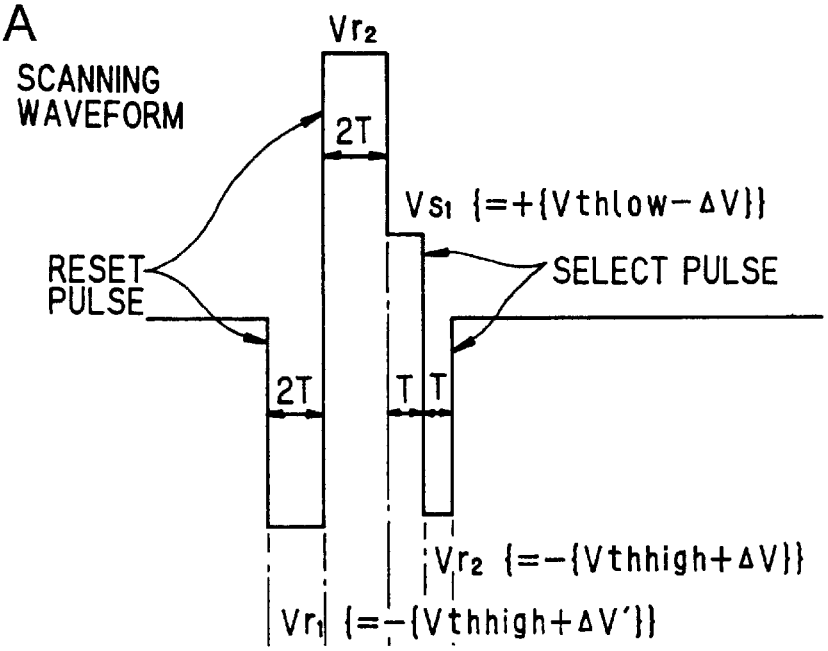
FIG. 1 is a diagram of a driving waveform used in a liquid crystal display according to the invention.
Figure 1B:
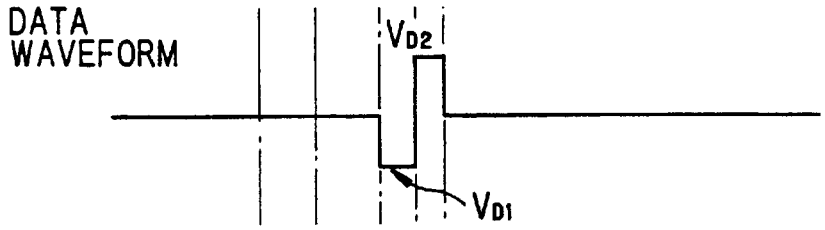
Figure 1C:
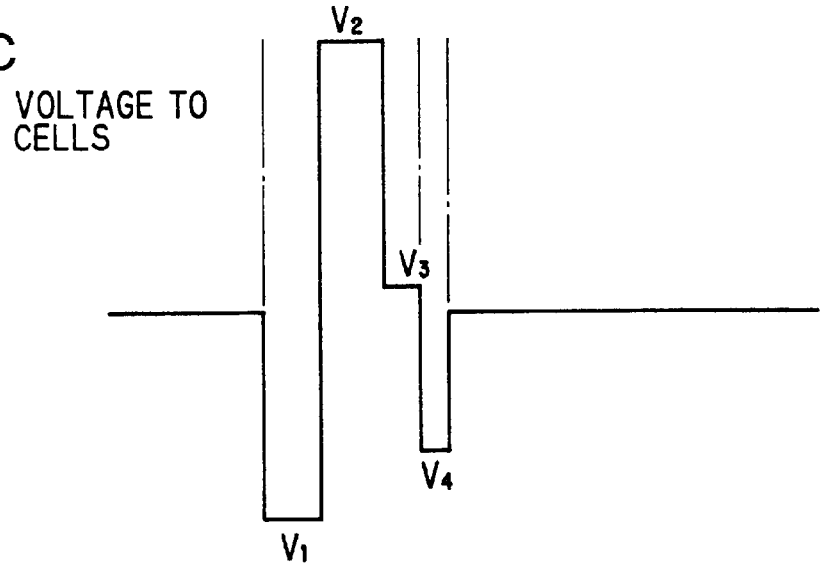
Figure 2:
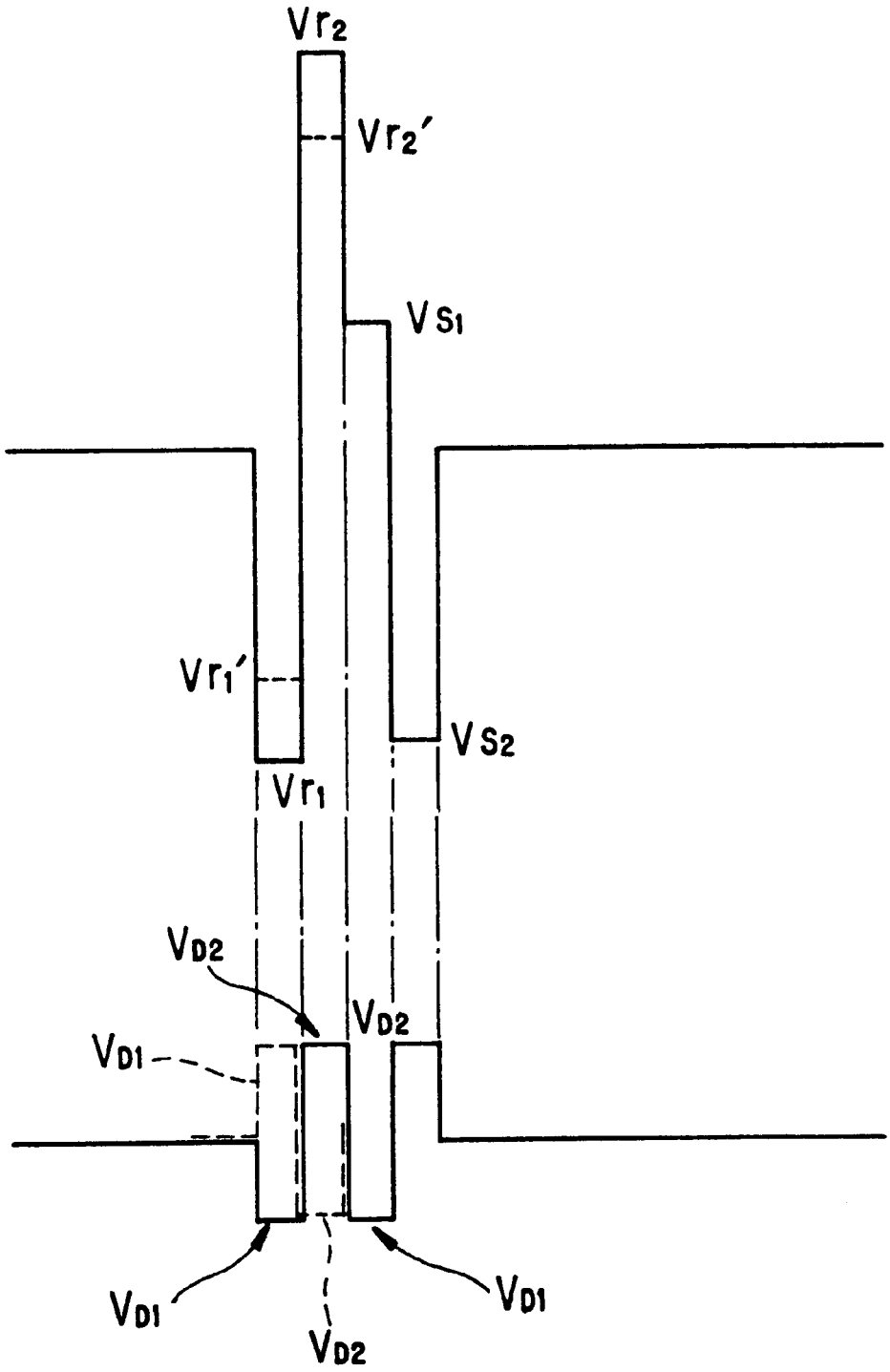
FIG. 2 is a diagram of a modification of the driving waveform shown in FIG. 1.
Figure 3:
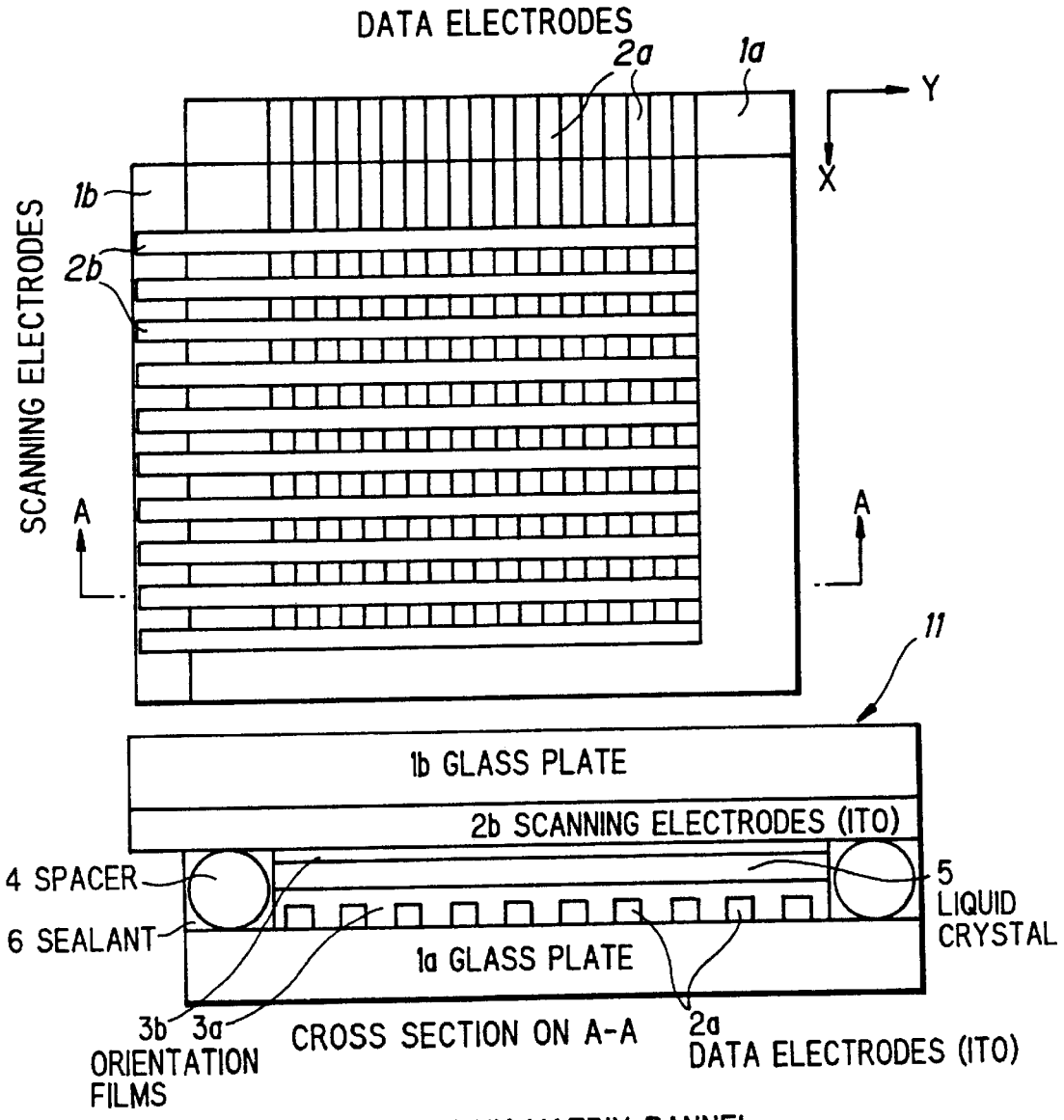
FIG. 3 is a schematic plan view and cross section of the liquid crystal display according to the invention.
Figure 4:
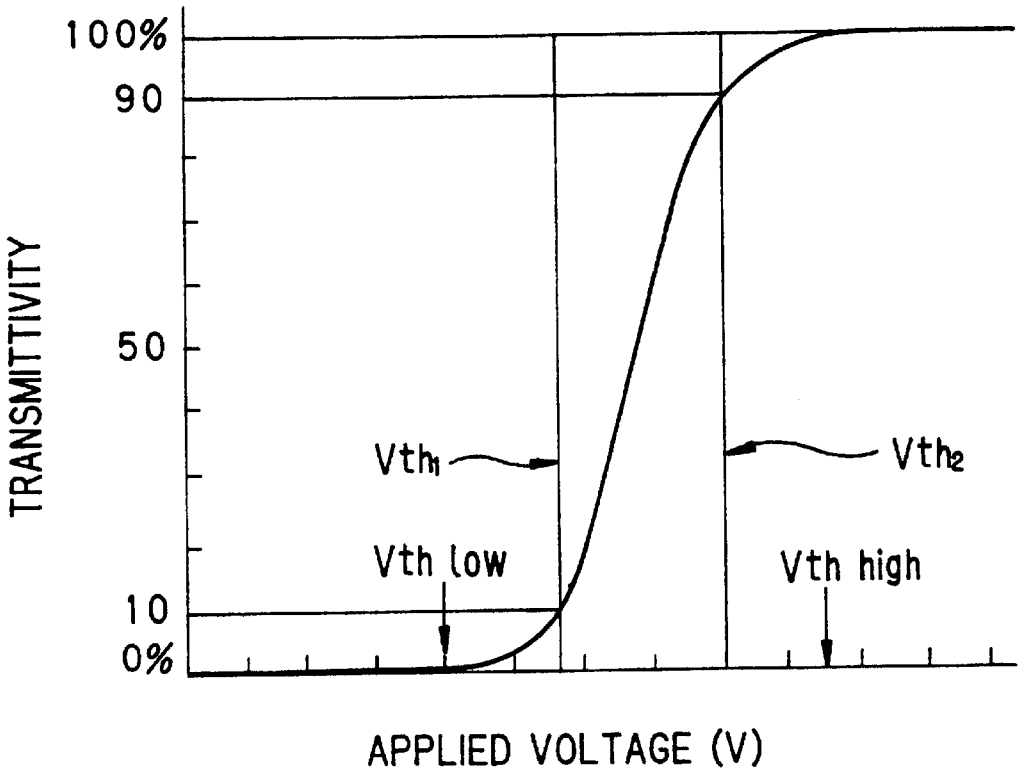
FIG. 4 is a graph showing the transmittivity-applied voltage characteristics, illustrating the threshold voltage characteristics of the liquid crystal display shown in FIG. 3.
Figure 5A:
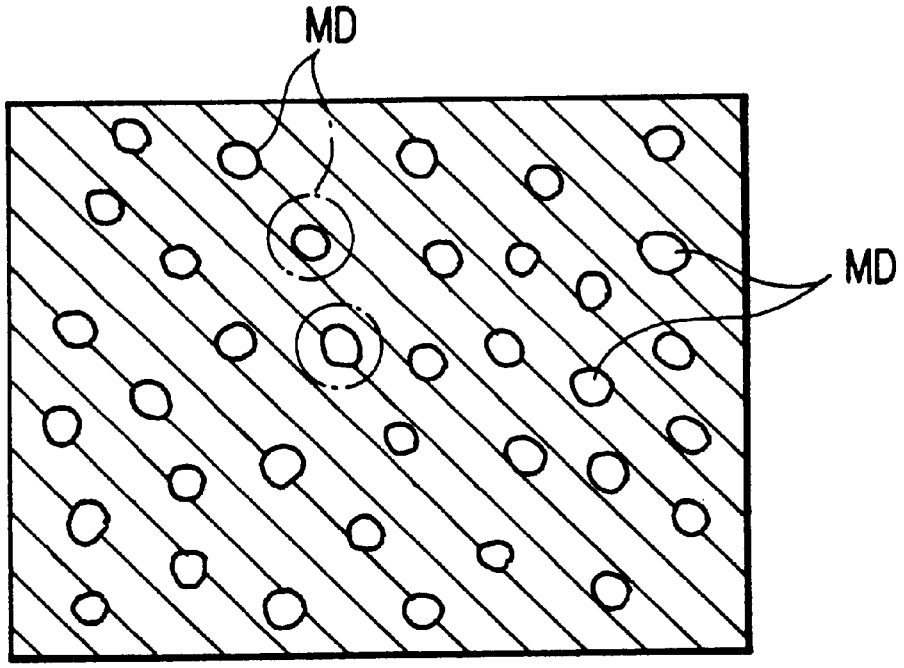
FIG. 5(A) is a schematic view illustrating variations in the transmittivity occurring during switching of the liquid crystal display shown in FIG. 3.
Figure 5B:
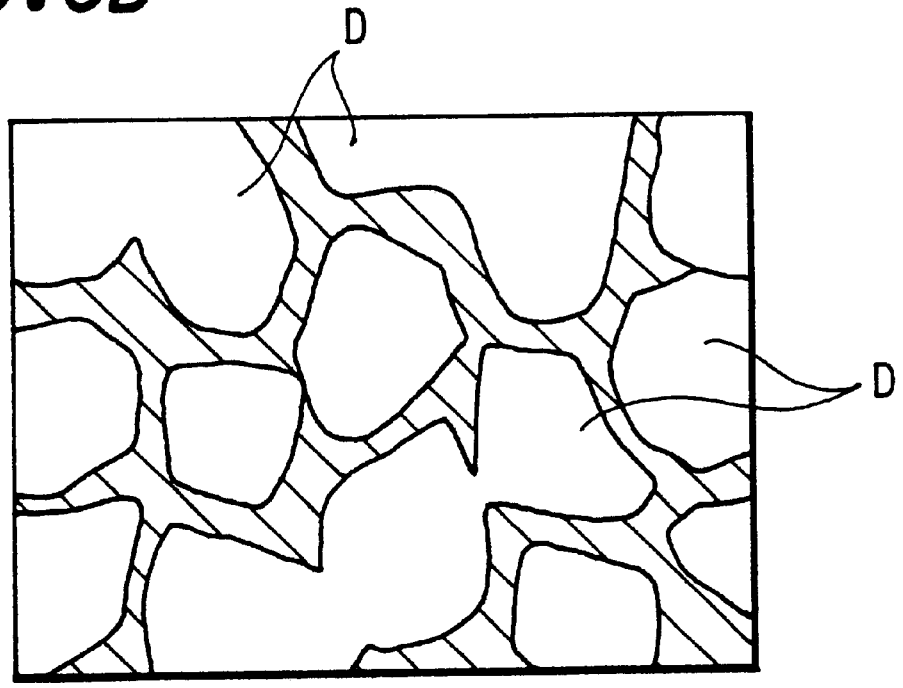
FIG. 5(B) is a schematic view similar to FIG. 5(A), but in which no gray scale is created.
Figure 6:
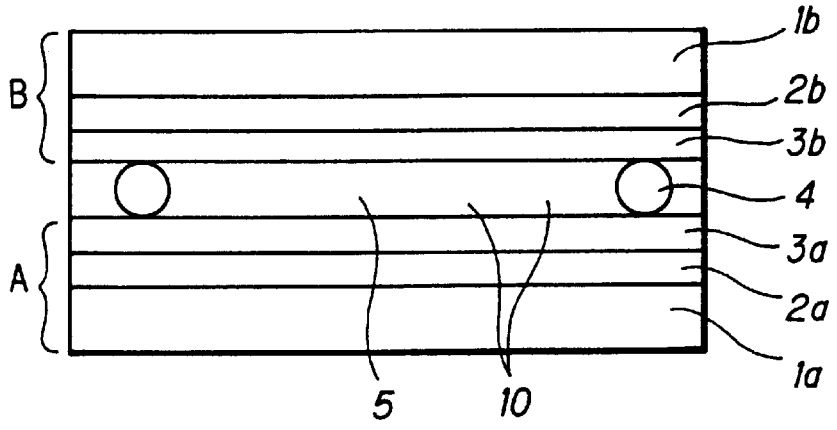
FIG. 6 is a schematic cross section of a fundamental structure of a liquid crystal display.
Figure 7:
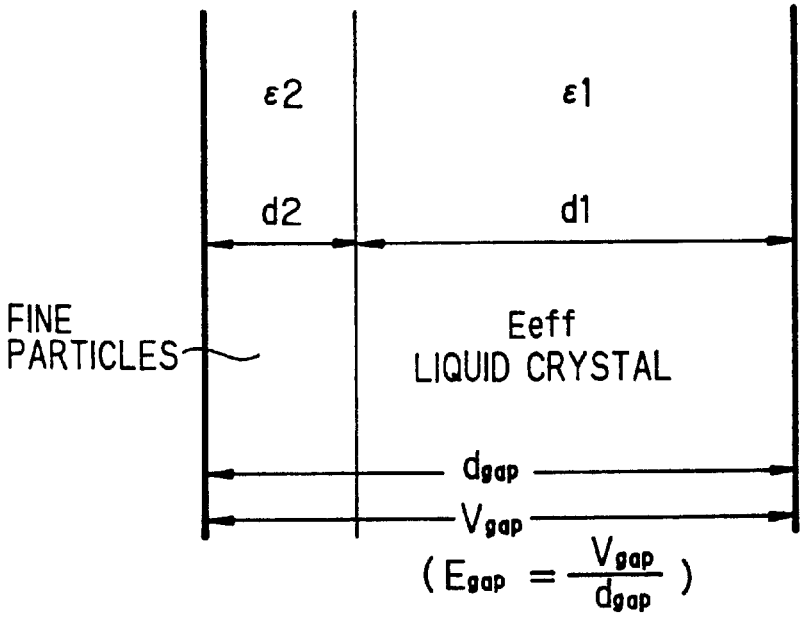
FIG. 7 is a schematic diagram illustrating the effective electric field within the liquid crystal material in the liquid crystal display shown in FIG. 6.
Figure 8:
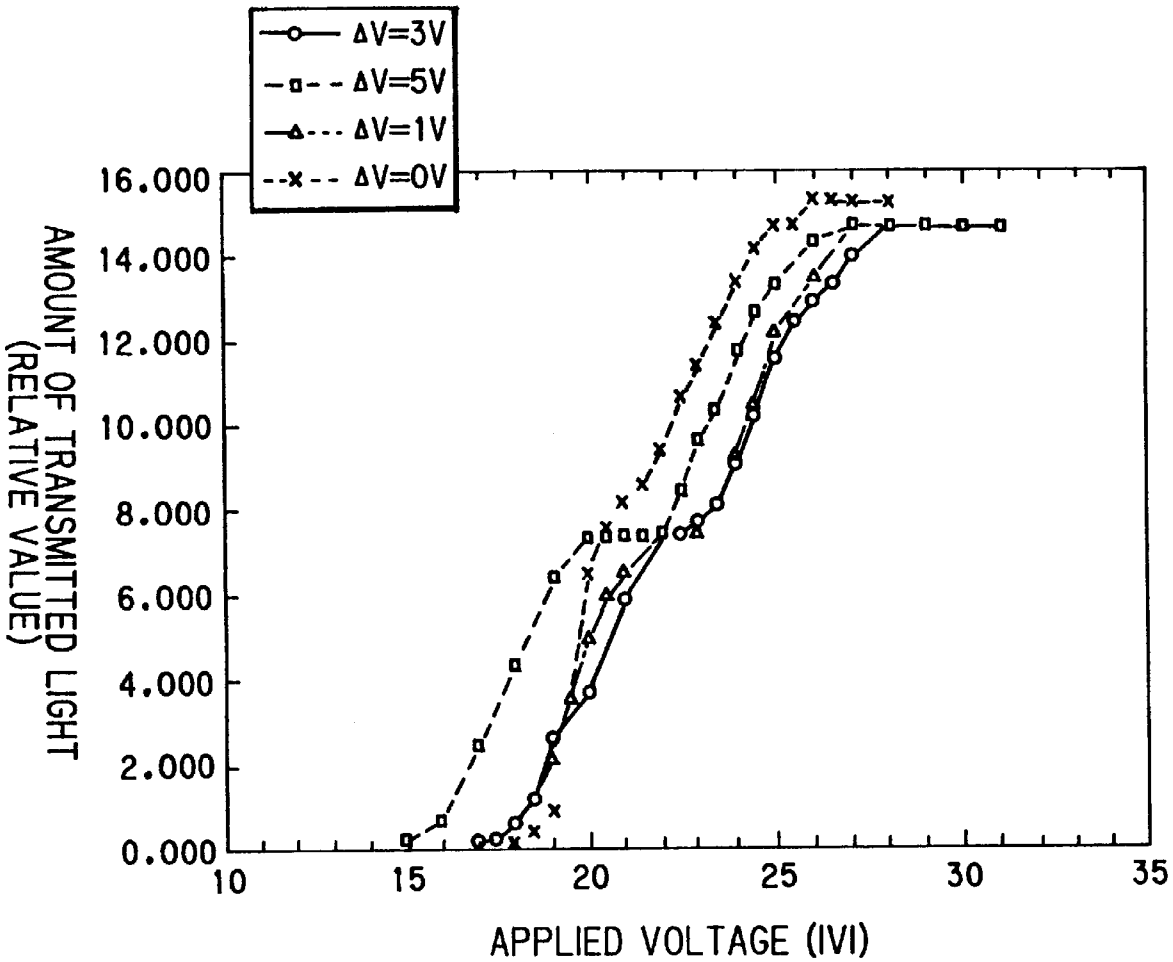
FIG. 8 is a graph showing the relation of the amount of transmitted light to the voltage applied to one example of the liquid crystal display shown in FIG. 6.

FIG. 8 shows variations in the transmittivity of the liquid crystal cell when a driving voltage was applied according to the present invention. The used cell had orientation films formed by depositing SiO parallel. The cell gap was 1.6 $\mu$m. The gap was measured by MS-2000 film thickness measuring instrument manufactured by Ohtsuka Electronic Corporation, Japan. In this cell, 1.3% of Morgal produced by Cabot Corporation was added to the liquid crystal material as the fine particles of carbon. The liquid crystal cell was placed between mutually crossing polarizers. In a memory state in which no voltage was applied, the orientation of the cell was set so that the transmittivity of the liquid crystal cell assumed its minimum value.

The width of the signal pulses was 350 $\mu$s. The reset pulses were twice as wide as the signal pulses, i.e., 700 $\mu$s. Since the threshold voltage $V_{thhigh}$ was 34 V in this cell, the reset voltage was set to 35 V. The signal voltage was changed from 18 V to 30 V. Variations in the transmittivity of the cell were measured. As can be seen from FIG. 8, the transmittivity of the cell varied continuously when the applied voltage was changed from 18 V to 28 V. Consequently, the transmittivity of the liquid crystal cell could be controlled by controlling the intensity of the voltage.

The unsymmetrical component ΔV of the select pulse waveform was continuously changed, and variations in the threshold value characteristics of the electrooptical characteristics of the liquid crystal material were investigated. In Table 1 below, the values of the selecting pulse voltage and of the reset pulse voltage are listed, together with various values of ΔV.

TABLE 1

(CONFIGURATION OF UNSYMMETRICAL SCANNING SIGNALS)

| ΔV | reset $V_{r1}$ | reset $V_{r2}$ | select $V_{s1}$ | select $V_{s2}$ |
|---|---|---|---|---|
| 0 V | −35 V | +39.5 V | +19 V | −28 V |
| 1 V | −35 V | +40.5 V | +18 V | −29 V |
| 3 V | −35 V | +42.5 V | +16 V | −31 V |
| 5 V | −35 V | +44.5 V | +14 V | −33 V |

FIG. 8 shows the results of measurements of the relation between the transmittivity of the ferroelectric liquid crystal cell and the applied voltage when the above-described unsymmetrical waveform was applied to parallel cells. It can be seen that the range in which the transmittivity varies continuously is enlarged as ΔV is increased. Obviously, this is advantageous for analog gray scale representation. Usually, ΔV is 1 to 10 V, preferably 2 to 5 V.

The switching process of the liquid crystal molecules was examined with a polarizing microscope. During application of the unsymmetrical waveform, when the data signal was 0, the molecules lying in the top and bottom layers were oriented in exactly the same direction. Good extinction state was obtained between the crossing polarizers. On the other hand, when the data signal was high, exactly the same extinction state was derived. A high contrast was obtained between these two orientation states.

EXAMPLE 2

A second cell was created. This second cell was similar to the cell of Example 1 except that the cell gap was 1.8 $\mu$m and that SiO was deposited on the orientation films in antiparallel directions. The relation of the transmittivity to the applied voltage of this cell was measured and shown in FIG. 9. The orientation of the cell was so set that when no electric field was applied, the transmittivity of the cell assumed its maximum value.

The width of the signal pulses forming the driving waveforms was 350 $\mu$s. The reset pulses were twice as wide as the signal pulses, i.e., 700 $\mu$s. The voltages of the reset pulses and select pulses are listed in Table 2 below.

TABLE 2

(DRIVING WAVEFORM FOR ANTIPARALLEL CELL)

| ΔV | reset $V_{r1}$ | reset $V_{r2}$ | select $V_{s1}$ | select $V_{s2}$ |
|---|---|---|---|---|
| 0 V | −35 V | +37.5 V | +27 V | −34 V |
| 3 V | −35 V | +41.5 V | +24 V | −37 V |
| 5 V | −35 V | +43.5 V | +22 V | −39 V |

Figure 9:
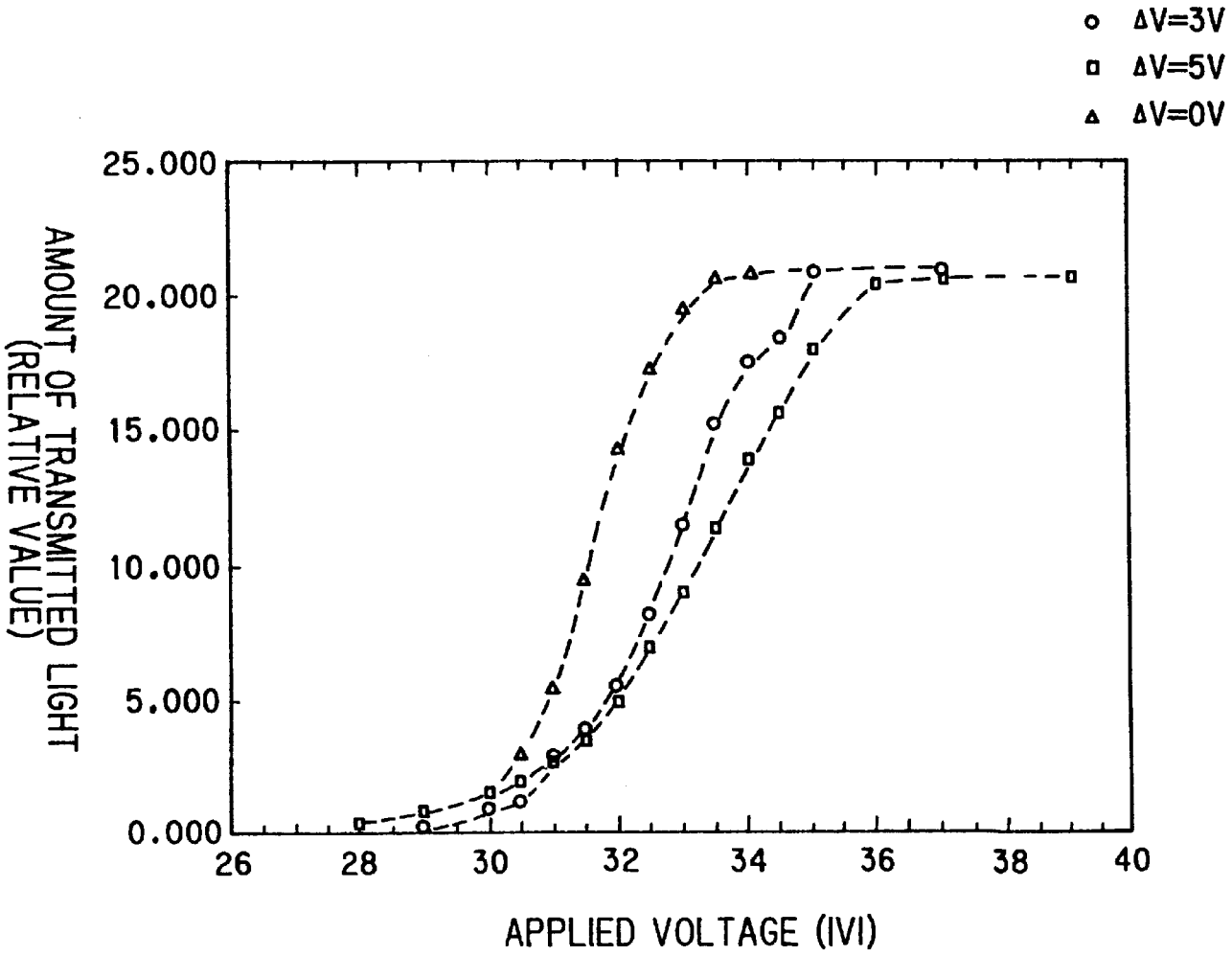
FIG. 9 is a graph showing the relation of the amount of transmitted light to the voltage applied to another example of the liquid crystal display shown in FIG. 6.

The transmittivity was measured while varying the signal voltage from 25 V to 30 V. The results are shown in FIG. 9. It can be seen that the transmittivity can be controlled in the same way as in Example 1. The range of the threshold voltage can be enlarged according to ΔV, and the ability to represent various gray levels can be improved.

EXAMPLE 3

Fine particles of carbon was mixed into a ferroelectric liquid crystal material, based on the data described in Examples 1 and 2. The liquid crystal display was driven with matrix addressing to produce various gray levels.

Figure 10A:
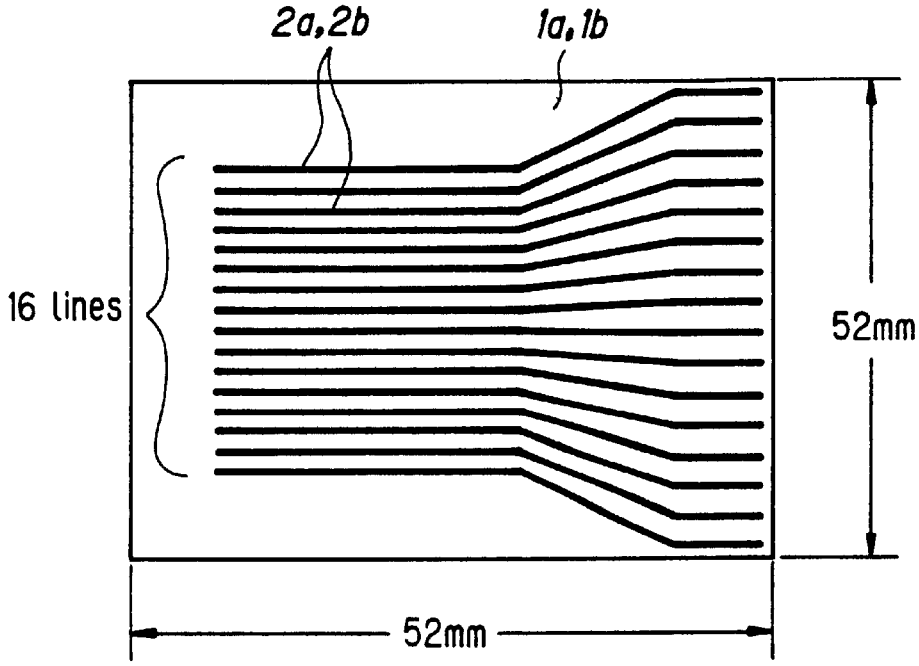
FIGS. 10(*a*) and 10(*b*) are schematic plan views of specific examples of electrode pattern formed in the liquid crystal display shown in FIG. 6.
Figure 10B:
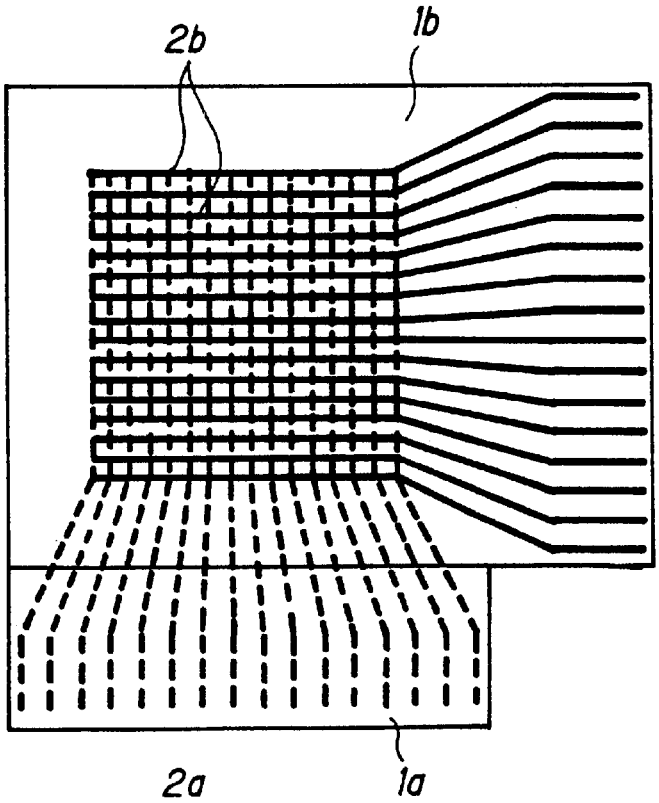

The cell was fabricated in the manner described now. Corning 7059 glass was used as glass substrates each measuring 25×52×0.7 $mm^3$. Electrodes were fabricated out of ITO by sputtering. The shape is shown in FIG. 10(*a*). The resistance of the ITO electrodes was 100 $\Omega/cm^2$. The cell was fabricated from the two glass substrates in such a way that the electrodes formed on these substrates crossed each other as shown in FIG. 10(*b*).

Orientation films were formed by depositing SiO obliquely in antiparallel directions. The cell gap was 1.5 $\mu$m. Morgal was used as fine particles of carbon. The concentration of the fine particles in the liquid crystal material accounted for 2%. CS-1014 manufactured by Chisso Petrochemical Corporation was used as the liquid crystal material.

Figures 11A, 11B, 11C, 11D, 11E, 11F, 11G, 11H, 11I, 11J, 11K, 11L, 11M, 11N, 11O, 11P:
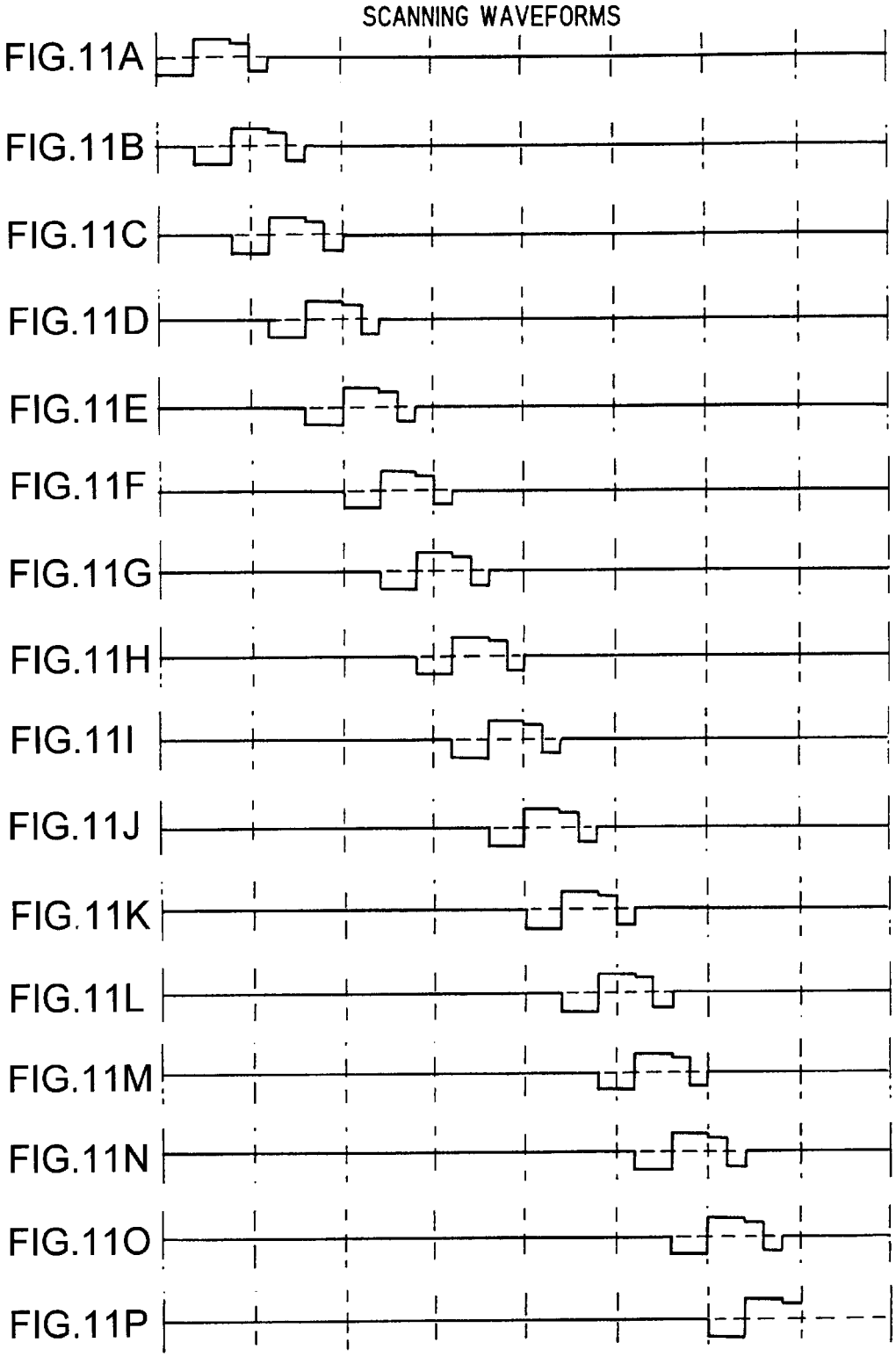
FIG. 11 is a diagram showing scanning waveforms used in a method according to the invention.

FIG. 11 shows the scanning waveform applied to the electrodes 2*b* arranged in the X-direction on the substrate 1*b*. FIG. 12 shows the data waveform applied to the electrodes 2*a* arranged in the Y-direction on. the substrate 1*a*. Signals applied to the scanning electrodes are configured as follows. The reset voltage was 24 V, while the select voltage was 20 V. The width of the select pulse was 400 $\mu$s. The reset pulse was twice as wide as the select pulse, or 800 $\mu$s. The pulse width of the voltage applied to the data electrodes was 300 $\mu$s in the same way as the select pulse. The amplitude of the voltage was varied from 10 V to 2.5 V.

Figure 13:
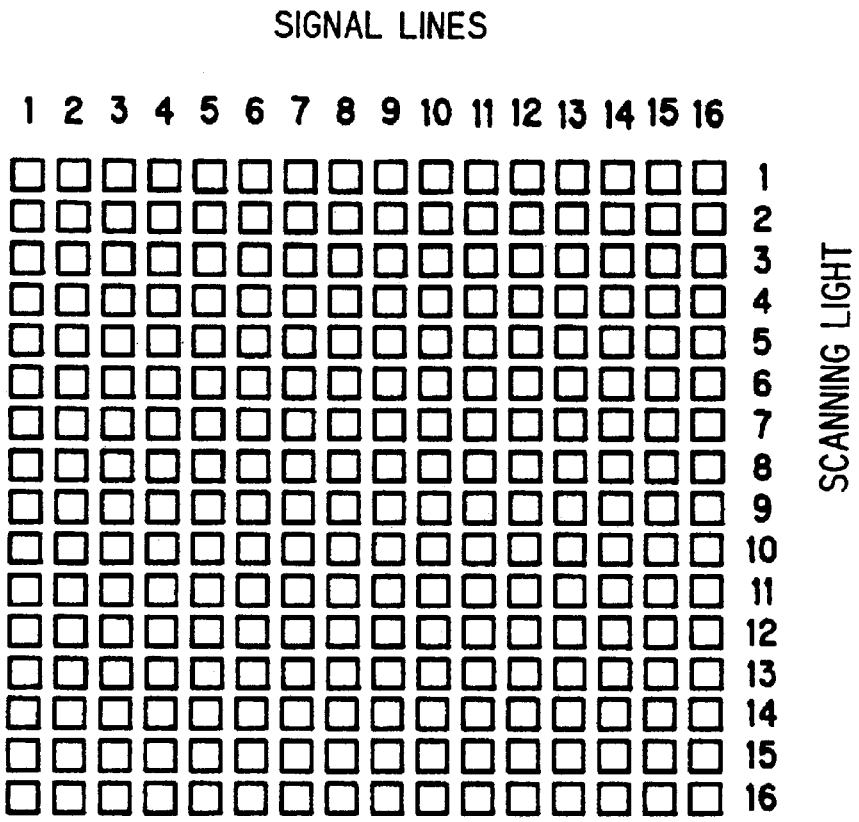
FIG. 13 is a diagram showing a display pattern obtained with the waveforms shown in FIGS. 12 and 13.

FIG. 13 shows the pattern of display provided by the applied waveform. It can be seen that a good gray scale was accomplished.

EXAMPLE 4

Figure 14:
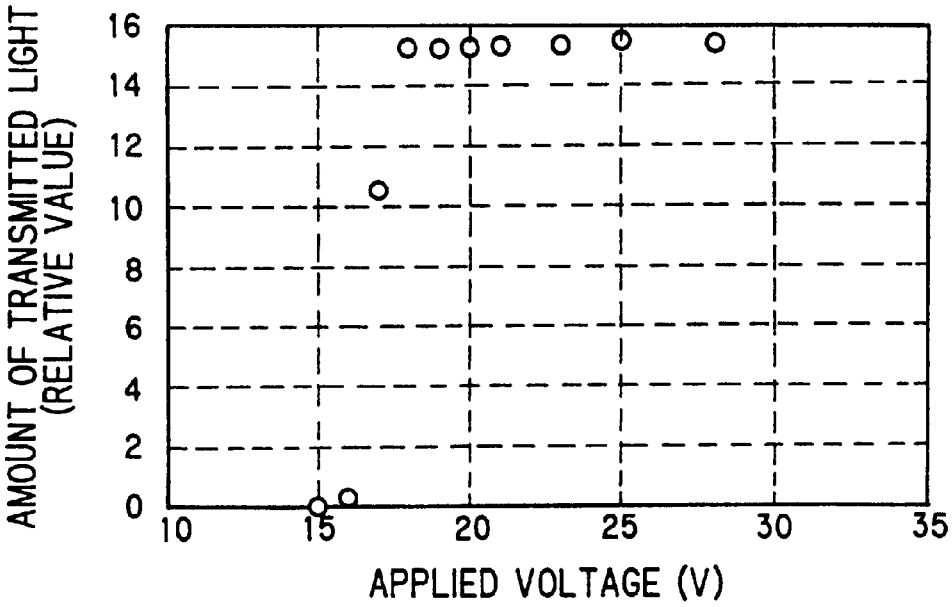
FIG. 14 is a graph showing the relation of the amount of transmitted light to the voltage applied to another liquid crystal display according to the invention.

A liquid crystal was fabricated similarly to Example 1 except that a liquid crystal material to which no carbon fine particles were added was used. The pulse voltage was configured as shown in Table 1 above. The relation between the transmittivity and the applied voltage was measured while varying $\Delta V$. The results are shown in FIG. 14. We observed that even when no fine particles of carbon were added, the range of threshold voltage was enlarged by $\Delta V$.

COMPARATIVE EXAMPLE

A ferroelectric liquid crystal display was manufactured in the manner described below according to the techniques disclosed in the above-cited Japanese Patent Laid-Open No. 276126/1991.

A glass plate having a length of 40 mm, a width of 25 mm, and a thickness of 3 mm was prepared. Transparent ITO electrodes were formed on the glass plate. The surface resistance of the ITO electrodes was 100 $\Omega/cm^2$, and the ITO film had a thickness of 500 Å. Polyimide JALS-246 prepared by Japan Synthetic Rubber Co., Ltd was applied by spin coating to a thickness of 500 Å at 300 rpm for 3 seconds and at 3000 rpm for 30 seconds. The glass substrate coated with the polyimide was rubbed three times by a rubbing machine having a roller on which cloth of rayon was firmly wound. The fur was depressed to a thickness of 0.15 mm. The rotational speed of the roller was 94 rpm. The stage feed speed was 5 cm/min.

Alumina having a grain diameter of 0.5 $\mu$m was dispersed on the substrate by a spacer sprayer manufactured by Sonocom Corporation such that 300 particles were dispersed per $mm^2$. If the density is increased above this level, the fine particles of alumina would coagulate. Spacer particles of 2 $\mu$m were dispersed on the substrate by the same spacer spraying machine at a density of 25 particles per $mm^2$.

Structbond manufactured by Mitsui Toatsu Chemicals, Japan, was applied as a sealant on the outer periphery of the opposite glass substrate by a screen printing machine. Both substrates were aligned to each other. A uniform pressure was applied until a uniform gap of 1.7 $\mu$m was obtained between the stuck substrates. Both parallel and antiparallel orientation directions were utilized. The pressure was 1 $kg/cm^2$. The cell was placed into a fan forced heater while the substrates were bonded together. The cell was maintained at 180° C. for 2 hours to cure the sealant. Then, the gap was measured with a cell gap measuring instrument manufactured by Ohtsuka Electronics Co., Japan. We confirmed that the gap was controlled to 1.7 $\mu$m±0.1 $\mu$m over the whole cell.

Ferroelectric liquid crystal material ZLI-3775 manufactured by Merck Japan Limited was deaerated at 80° C. in a vacuum. The temperature of the material was then elevated to 110° C. at which the liquid crystal material was in an isotropic temperature region. This liquid crystal material was injected into the cell in a vacuum. It took 1.5 hours to complete this process. After slowly cooling the cell down to room temperature, the cell was sandwiched between two crossing polarizers. The orientation of the liquid crystal molecules was observed with a microscope. Also, the electrooptical characteristics were measured.

Figure 15A:
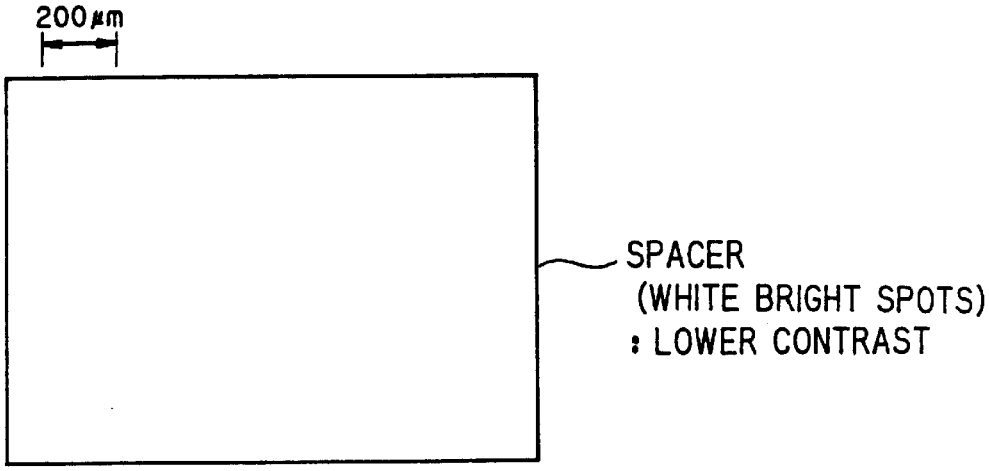
FIG. 15(A) is a schematic diagram illustrating the manner in which a liquid crystal display according to the invention is in a transmissive state.
Figure 15B:
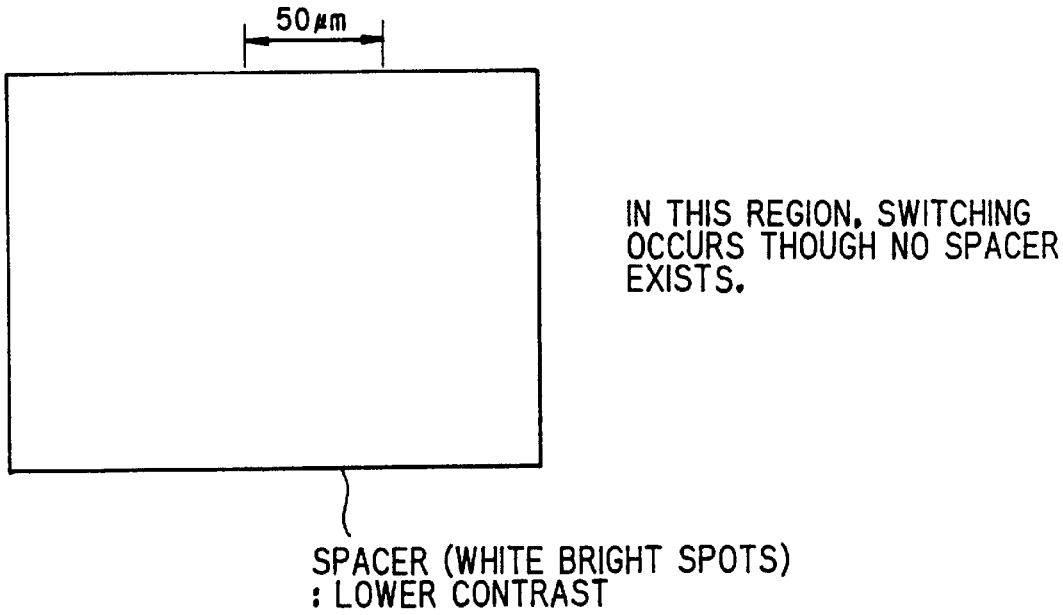
FIG. 15(B) is a schematic diagram similar to FIG. 15(A), but showing a comparative example.
Figure 16:
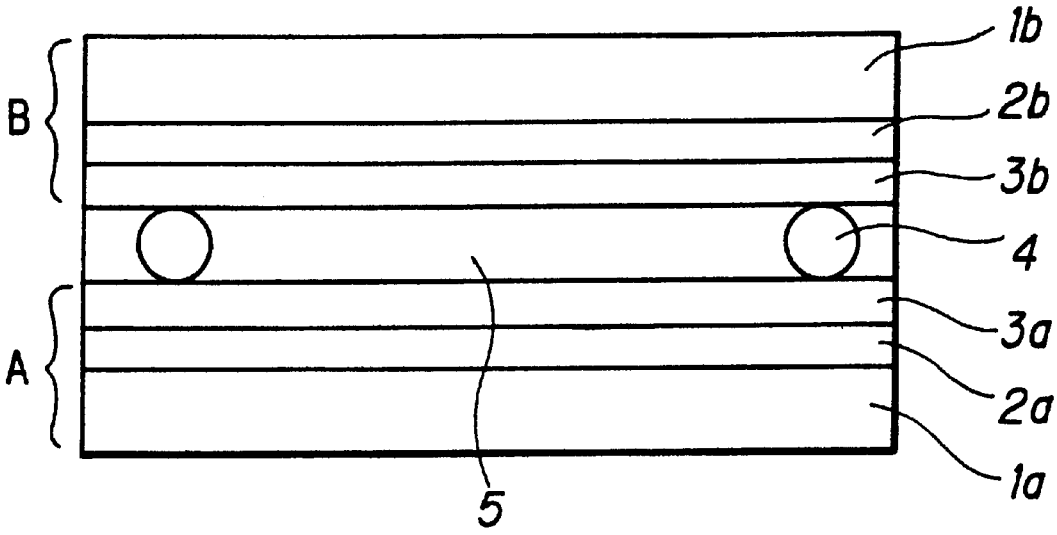
FIG. 16 is a schematic cross section of the prior art liquid crystal display.
Figure 17:
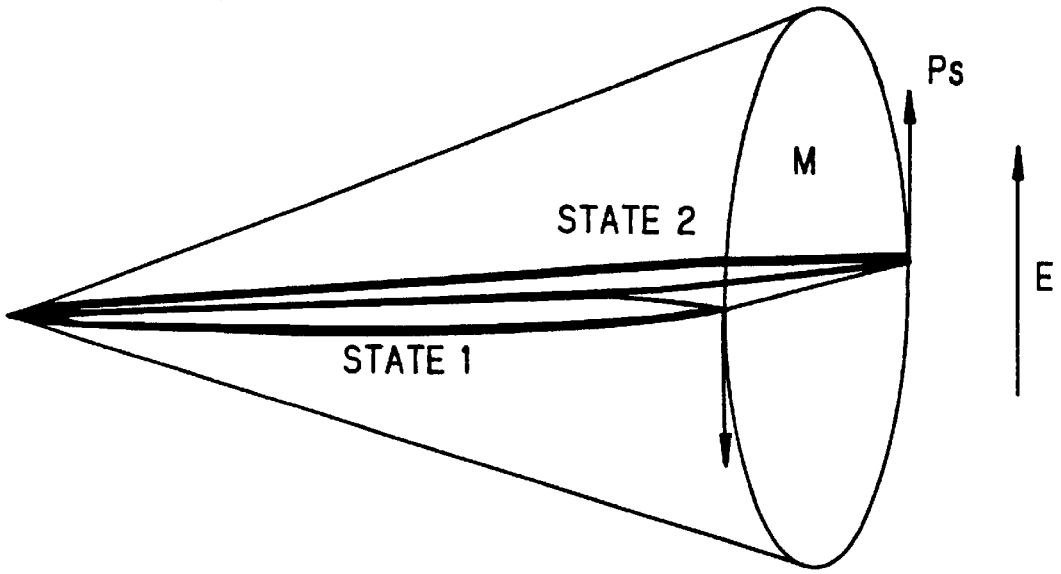
FIG. 17 is a diagram illustrating a model of a ferroelectric liquid crystal.
Figure 18:
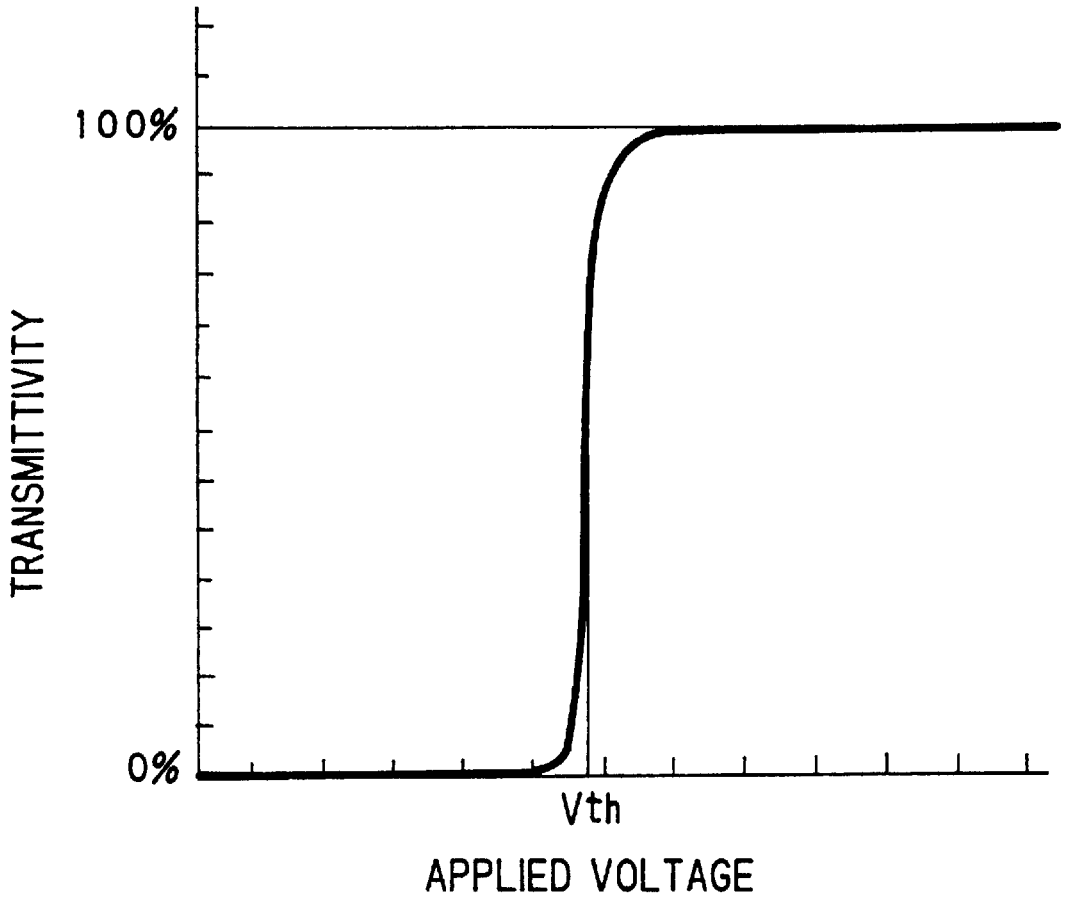
FIG. 18 is a graph showing the transmittivity-applied voltage characteristic curve illustrating the threshold voltage characteristics of the prior art liquid crystal display.
Figure 19:
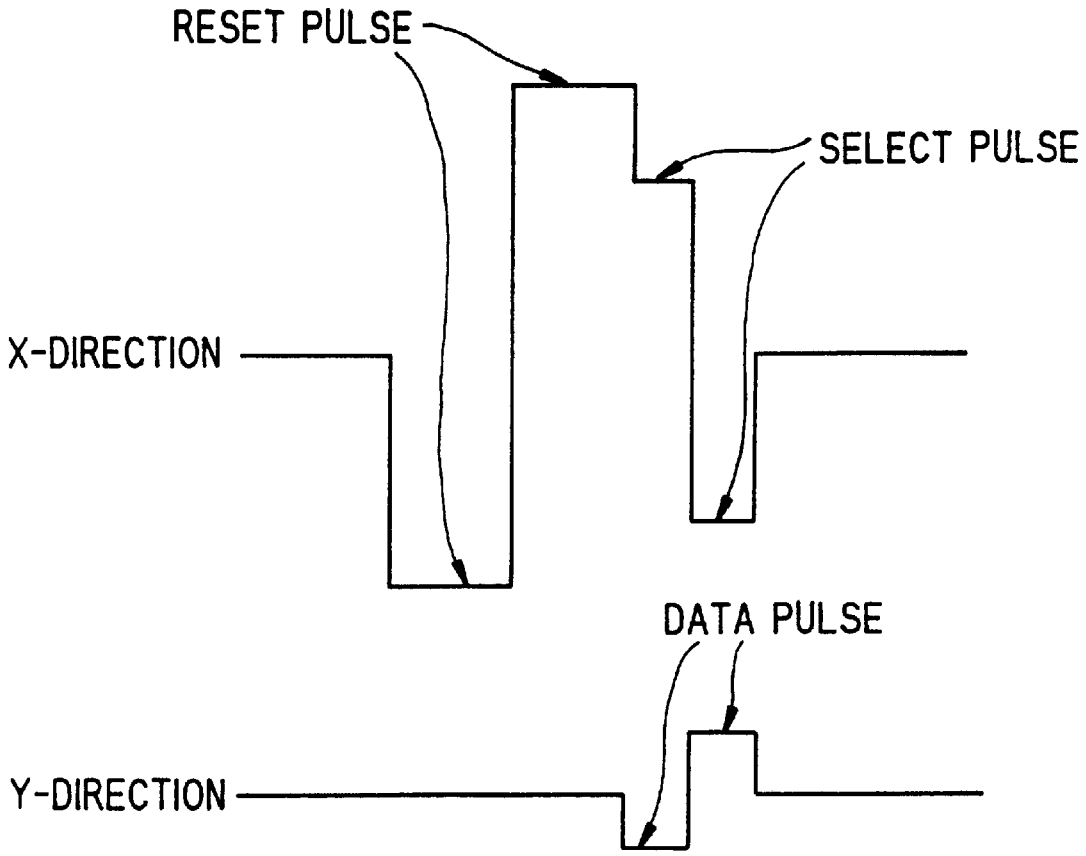
FIG. 19 is a diagram illustrating driving waveforms used in the prior art liquid crystal display.
Figure 20A:
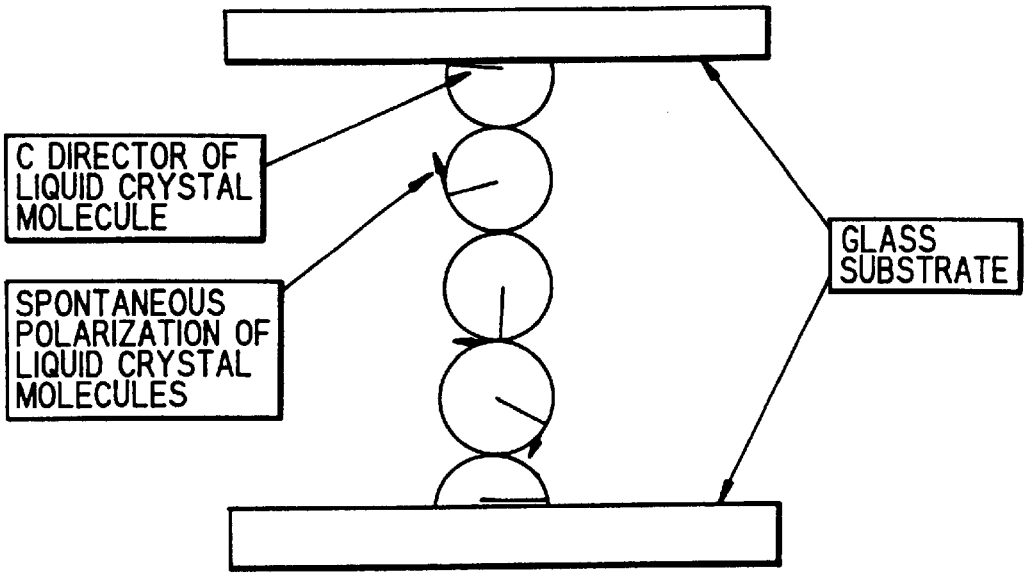
FIG. 20 is a diagram illustrating orientation assumed when liquid crystal molecules are activated.
Figure 20B:
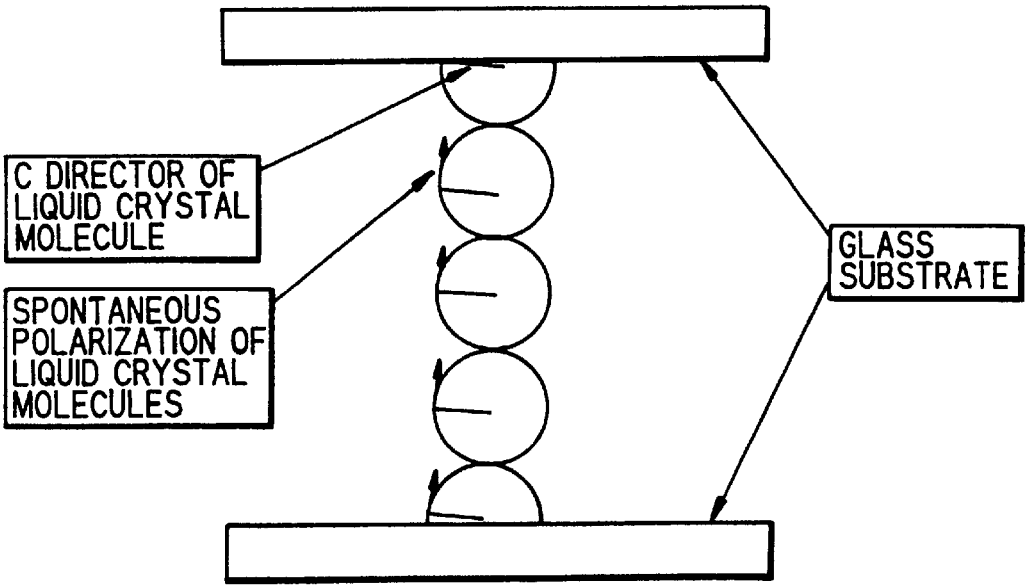

1) With respect to orientation of liquid crystal molecules:

parallel oriented cell: As shown in FIGS. 15(A) and 15(B), even if the surroundings of the spacers were entirely black, leakage of light took place. This resulted in a decrease in the black level, which in turn became a main cause of a decrease in the contrast of the cell.

Since the ferroelectric liquid crystal produced a visible image in birefringent mode, the cell gap had to be controlled to the optimum value quite uniformly. In adjacent regions in which the alumina particles of 0.5 $\mu$m were dispersed, the particles acted as spacers. As a result, the cell gap deviated greatly from the optimum value. Hence, conspicuous color nonuniformities were observed. Obviously, this greatly degraded the quality of display. We consider that this was caused by the fact that the spacers were sufficiently large compared with the wavelength of the visible light. If the density at which the spacers were dispersed was increased exorbitantly, light leakage around the spacers lowered the contrast with undesirable results.

However, the starlight texture structure applied to the invention exploits the aforementioned dispersion of the ultrafine particles. Therefore, light leakage decreases. Also, the orientation of the liquid crystal molecules is not disturbed. Rather, a distribution of dielectric constant effectively produces a distribution of effective electric field.

antiparallel oriented cell: Thin fringes on the order of microns were observed as orientation texture of the liquid crystal molecules. Even if the surroundings of the spacers were totally black, light leakage occurred. This resulted in a decrease in the black level, which in turn became a main cause of a decrease in the contrast of the cell. Furthermore, many defects were observed around the spacers. We consider that this is a main cause of the light leakage.

2) With respect to electrooptical effect:

parallel oriented cell: A reset pulse having a pulse width of 1 ms and a voltage of 30 V was applied with a bipolar transistor and then a signal pulse having a pulse width of 1 ms was applied. The voltage of the signal pulse was varied from 1 V to 30 V. We examined whether the resulting variations in the transmittivity differed from the variations caused in the bistable mode ferroelectric liquid crystal.

As a result, when a voltage was applied while varying its value, observation with a microscope did not indicate that the liquid crystal molecules began to move from the top layer of the spacers. The liquid crystal molecules were oriented at random over the spacers and never uniform. When the whole was black, they were observed as bright spots. When the whole was white, they were observed as black spots. In either case, the contrast was decreased (FIG. 15).

With respect to inversion or switching that is important for the present invention, inversion may start from the spacers or from their vicinities. It was also observed that inversion started from other portions. That is, inversion does not always start from the spacers and from their vicinities.

More importantly, if inversions take place, domains are enlarged. If this enlargement has a range of threshold voltage values, the switching voltage must also has a range. However, the results indicate that the range of the threshold voltage values is not substantially wider than the range obtained in the prior art techniques. More specifically, in this system, the range of the threshold voltage values was 1 V. The voltage was varied, and variations in the switching domains were observed. The results reveal that they were typical boat type domains. Zigzag defects were observed sporadically at the edges of the cell. Therefore, we have confirmed that this layer structure takes the chevron structure. With respect to the switching characteristics of the whole cell, inversions may start from the spacers or from their vicinities. Hence, the switching characteristics were similar to the characteristics of ordinary cells. Hence, plural gray levels could never be accomplished within one pixel.

antiparallel orientation cell: After a reset pulse having a pulse width of 1 ms and a voltage of 30 V was applied with a bipolar transistor, a signal pulse having a pulse width of 1 ms was applied. The voltage of this signal pulse was varied from 1 V to 30 V. We examined whether the resulting variations in the transmittivity differed from the variations caused in the conventional bistable mode ferroelectric liquid crystal.

As a result, when a voltage was applied while varying its value, observation with a microscope did not indicate that the liquid crystal molecules began to move from above the spacers. Switching took place along thin fringes appearing in the direction of rubbing, the fringes being on the order of microns.

Also in this structure, the liquid crystal molecules were disturbed over the spacers and never uniform (FIG. 15).

The density at which the spacers were dispersed was varied, and the resulting effects were examined. Experiment has shown that the switching characteristics of the whole cell in which the spacers were dispersed at a density of 0 to 500/mm$^2$ are similar to the characteristics of the cell having the above-described dispersion density of 300/mm$^2$.

In the case of the parallel orientation, devices having central cell gap values of 1.8 $\mu$m and 1.5 $\mu$m, respectively, showed exactly the same characteristics. In either case, the cell gap was controlled within ±0.1 $\mu$m. In the case of the antiparallel cell, devices having central cell gap values of 1.8 $\mu$m and 1.5 $\mu$m, respectively, showed exactly the same results.

In summary, we carried out experiments faithfully according to the embodiment of the display disclosed in the above-cited Japanese Patent Laid-Open No. 276126/1991. We have discovered that the gray scale representation technique disclosed in this patent specification does not exhibit the effects described in the specification. Hence, we have found that this technique is not a practical technique.

While the preferred embodiments of the invention have been described, the foregoing embodiments can be modified, based on the technical concept of the present invention.

For example, in the above-described driving method, the magnitudes, the pulse widths, the polarities, and other factors of the selecting pulses, reset pulses, and the data pulses can be changed variously.

Usable liquid crystal materials include liquid crystal material produced by Chisso Petrochemical Corporation, Merck Japan Limited, and BDH Corporation, other known ferroelectric liquid crystal materials, and non-chiral materials. No restrictions are imposed on the used material. Also, it is not necessary to place limitations on the phase sequence. The requirement is only that a chiral smectic phase is assumed in the used temperature range. Furthermore, the materials of the components of the liquid crystal display, the structure, the shape, the method of assembling the display, the physical properties of the ultrafine particles used to form the microdomains, and the kind of the ultrafine particles may be modified variously. Additionally, the method of adding the ultrafine particles may be changed. The ultrafine particles may be distributed on or in the orientation film, as well as in the liquid crystal material. Further, deposition or lamination of a charge-transfer complex such as tetrathiafulvalenetetracyanoquinodimethane may be used to form the microdomains.

In the above examples, the liquid crystal is suited for a display device. Where the invention is applied to a display device, there arises the advantage that half-tones can be achieved. However, the invention is not limited to display devices. Liquid crystal devices according to the invention can be applied to filters, shutters, display screens for apparatus used for office automation, and wobbling phase control devices. In any of these instruments, the above-described range of threshold voltage values permits the transmittance (or transmittivity) or the contrast ratio to be varied in response to the driving voltage. Utilizing this phenomenon, unprecedented performance can be obtained.

As described above, in the present invention, a liquid crystal display having a liquid crystal material sandwiched between a pair of bases is driven in such a way that first and second select pulses of opposite polarities are applied to the liquid crystal material and that the first and second select pulses have voltages $V_{s1}$ and $V_{s2}$, respectively, which are given by $\pm(V_{thlow}-\Delta V)$ (where $\Delta V>0$) and $\mp(V_{thhigh}+\Delta V)$ (where $\Delta V>0$), respectively. In these formulas, $V_{thlow}$ is the voltage applied when the transmittivity of the liquid crystal material begins to charge, and $V_{thhigh}$ is the voltage applied when the transmittivity of the liquid crystal material substantially assumes its maximum value. Therefore, the range of voltage in which the transmittivity of the liquid crystal varies continuously can be enlarged according to $\Delta V$. Hence, various gray levels can be produced easily and certainly. Furthermore, because of the driving operation within the voltage range described above, even if the data pulses or data signals are made to go high, plural transmittivities producing a sufficient difference can be obtained. High contrast can be derived between two orientation states.

What is claimed is:

1. A method of driving a liquid crystal display having a liquid crystal material sandwiched between a pair of bases, said method comprising the step of:

applying first select pulses and second select pulses having polarities opposite to each other and having voltages of $\pm(V_{thlow}-\Delta V)$ (where $\Delta V>0$) and $\mp(V_{thhigh}+\Delta V)$ (where $\Delta V>0$), respectively, where $V_{thlow}$ is a voltage applied when transmittivity of said liquid crystal material begins to change, and $V_{th-}$ $_{high}$ is a voltage applied when the transmittivity of said liquid crystal material substantially assumes its maximum value.

2. The method of claim 1, wherein said liquid crystal display contains regions having subtly different threshold voltage values at which said liquid crystal material is switched to other states, and wherein said liquid crystal display is matrix driven.

3. The method of claim 1, wherein (A) before said first and second select pulses are applied, first and second reset pulses having polarities opposite to each other and having pulse widths n times (n is a real number equal to or greater than 2) as wide as pulse widths of said first and second select pulses are applied, (B) said first reset pulse has the same polarity as said second select pulse and has a reset pulse voltage $V_{r1}$ given by $|(V_{thhigh}+\Delta V')|$, where $\Delta V'>0$, (C) said second reset pulse has the same polarity as said first select pulse and has a reset pulse voltage $V_{r2}$ given by $nV_{r1}+V_{s2}=nV_{r2}+V_{s1}$, wherein $V_{s1}$ and $V_{s2}$ are the first and second select pulses.

4. The method of claim 1, wherein a first and a second pulses having the same pulse width as said first and second select pulses and having a polarity opposite to said polarity of said first and second select pulses are applied in synchronism with said first and second select pulses.

5. The method of driving a liquid crystal display of claim 1, wherein $\Delta V$ is in a range from 1 to 10 volts.

6. The method of claim 5, wherein the bases are substantially parallel.

7. The method of driving a liquid crystal display of claim 1, wherein $\Delta V$ is in a range from 2 to 5 volts.

8. The method of claim 7, wherein the bases are substantially parallel.

9. The method of driving a liquid crystal display of claim 1, wherein fine particles are distributed between the bases.

10. The method of claim 9, wherein the fine particles have a size standard deviation of 9 nm.

11. The method of claim 10, wherein the bases are substantially parallel.

12. The method of claim 9, wherein the bases are substantially parallel.

13. The method of claim 1, wherein the bases are substantially parallel.

* * * * *